US009127497B2

(12) United States Patent
Safarik et al.

(10) Patent No.: US 9,127,497 B2
(45) Date of Patent: Sep. 8, 2015

(54) VARIABLE CONFIGURATION BLINDS

(71) Applicant: Diamond View Technology, LLC, Long Beach, CA (US)

(72) Inventors: James Safarik, Orange, CA (US); George P White, Long Beach, CA (US); Victor Rossi, Anaheim, CA (US)

(73) Assignee: Diamond View Technology, LLC., Long Beach, CA (US)

( * ) Notice: Subject to any disclaimer, the term of this patent is extended or adjusted under 35 U.S.C. 154(b) by 0 days.

(21) Appl. No.: 13/831,059

(22) Filed: Mar. 14, 2013

(65) Prior Publication Data

US 2013/0240159 A1 Sep. 19, 2013

Related U.S. Application Data

(63) Continuation of application No. PCT/US2013/031802, filed on Mar. 14, 2013.

(60) Provisional application No. 61/610,989, filed on Mar. 14, 2012.

(51) Int. Cl.
*E06B 3/48* (2006.01)
*E06B 9/26* (2006.01)
(Continued)

(52) U.S. Cl.
CPC ... *E06B 9/26* (2013.01); *E06B 9/30* (2013.01); *E06B 9/322* (2013.01); *E06B 9/386* (2013.01); *E06B 2009/2405* (2013.01)

(58) Field of Classification Search
CPC ..... E06B 9/303; E06B 9/305; E06B 9/32
USPC ..... 160/113, 115, 116, 167 R, 173 R, 160/178.1 R
See application file for complete search history.

(56) References Cited

U.S. PATENT DOCUMENTS 2,673,607 A * 3/1954 Rulfs ..... 160/115
4,708,188 A * 11/1987 Bytheway, Jr. ..... 160/174 R
(Continued)

FOREIGN PATENT DOCUMENTS

CA 2350106 12/2002
EP 513468 11/1992
(Continued)

OTHER PUBLICATIONS

Rospatent; International Search Report of PCT/US 2013/031802; Jul. 18, 2013; 2 pages.
(Continued)

*Primary Examiner* — Katherine Mitchell
*Assistant Examiner* — Scott Denion
(74) *Attorney, Agent, or Firm* — George P. White

(57) ABSTRACT

A slatted horizontal blinds system has separate positional controls for distinct subsets of slats. Odd and even slats can be moved relative to each other both horizontally and vertically. With a scalloped upper and lower edge, overlapping slats can produce a variety of light allowing and esthetic modes. Some versions only support up and down movement and some slats are rectangular. This is caused by hiding and exposing of slat portions and voids between slats by the relative movement of odd and even slats. Slats may have translucent colored portions, apertures or printed designs. The absolute movement may only be of one subset of slats while other slats stay in position. In other cases all slats can move simultaneously in relation to each other. Mechanisms include screw drive with "lost motion" operation and movement latches. Also slidable carriages, end-cams, and linear motors can be used. In some cases the bottom rail has mechanisms as well as the head rail.

13 Claims, 38 Drawing Sheets

(51) Int. Cl.

| | |
|---|---|
| ***E06B 9/30*** | (2006.01) |
| ***E06B 9/322*** | (2006.01) |
| ***E06B 9/386*** | (2006.01) |
| *E06B 9/24* | (2006.01) |

(56) References Cited

U.S. PATENT DOCUMENTS

| | | | | |
|---|---|---|---|---|
| 5,309,974 | A * | 5/1994 | Fraser | 160/176.1 R |
| 5,485,874 | A * | 1/1996 | Whitmore | 160/115 |
| 5,655,589 | A | 8/1997 | Vartanian | |
| 6,015,001 | A * | 1/2000 | Tronsgard et al. | 160/115 |
| 6,076,587 | A * | 6/2000 | Pastor | 160/115 |
| 6,179,035 | B1 | 1/2001 | Anderson | |
| 6,196,292 | B1 | 3/2001 | Jackson | |
| 6,648,048 | B2 | 11/2003 | Lai | |
| 6,845,802 | B1 * | 1/2005 | Anderson et al. | 160/115 |
| 7,174,942 | B2 | 2/2007 | Hsu | |
| 7,296,606 | B2 * | 11/2007 | Liang | 160/115 |
| 7,308,927 | B2 * | 12/2007 | Lai | 160/116 |
| 7,392,628 | B2 | 7/2008 | Logan | |
| 7,424,905 | B2 | 9/2008 | Lai | |
| 7,451,798 | B2 | 11/2008 | Lai | |
| D594,683 | S | 6/2009 | Safarik | |
| 7,624,784 | B2 | 12/2009 | Anthony et al. | |
| 7,658,218 | B2 | 2/2010 | Lai | |
| 7,926,540 | B2 * | 4/2011 | Lai | 160/176.1 R |
| 2001/0052397 | A1 * | 12/2001 | Matsubara | 160/115 |
| 2003/0051824 | A1 * | 3/2003 | Lin | 160/115 |
| 2003/0127197 | A1 * | 7/2003 | Lai | 160/115 |
| 2006/0130981 | A1 * | 6/2006 | Marzilli | 160/115 |
| 2006/0130982 | A1 | 6/2006 | Lai | |
| 2006/0248801 | A1 | 11/2006 | Marocco | |
| 2006/0283560 | A1 | 12/2006 | Lai | |
| 2008/0121348 | A1 | 5/2008 | Spencer | |
| 2009/0314440 | A1 | 12/2009 | Lai | |
| 2010/0132260 | A1 | 6/2010 | Lee | |
| 2011/0214823 | A1 * | 9/2011 | Hu et al. | 160/168.1 R |

FOREIGN PATENT DOCUMENTS

| | | |
|---|---|---|
| GB | 2222192 | 2/1990 |
| WO | WO2006007842 | 1/2006 |

OTHER PUBLICATIONS

Rospatent; Written Opinion of the International Searching Authority of of PCT/US 2013/031802; Jul. 18, 2013; 3 pages.

* cited by examiner

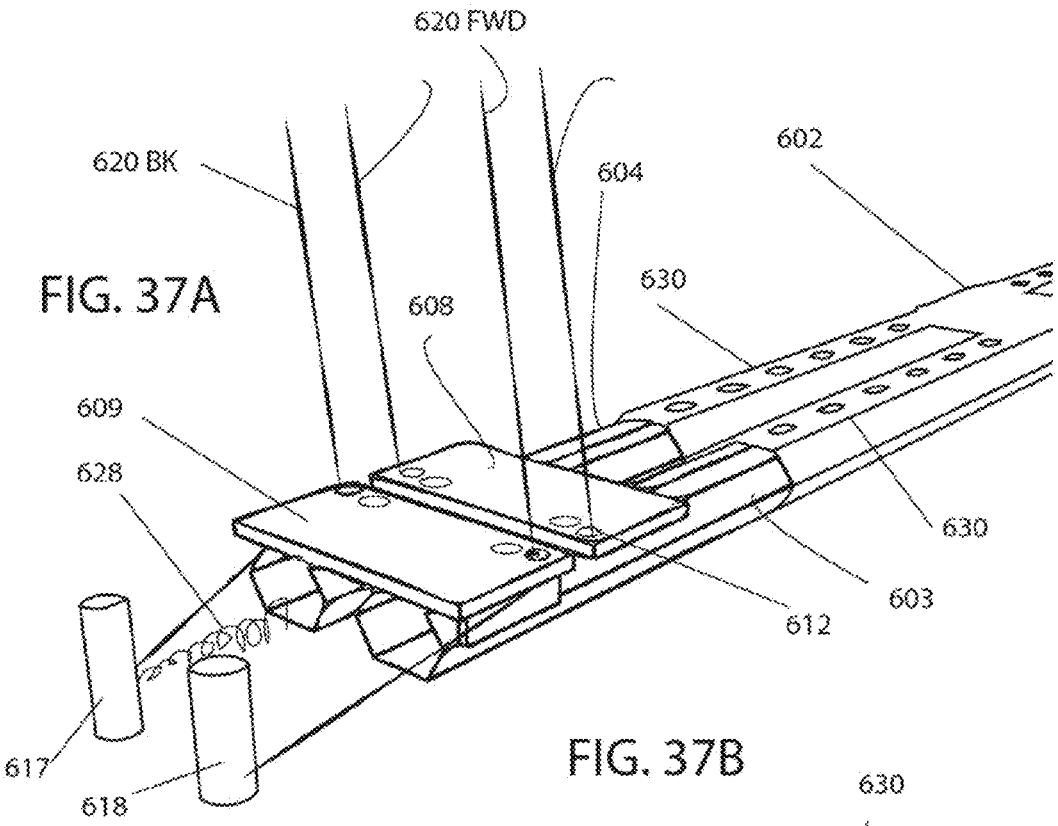
FIG. 37A
FIG. 37B
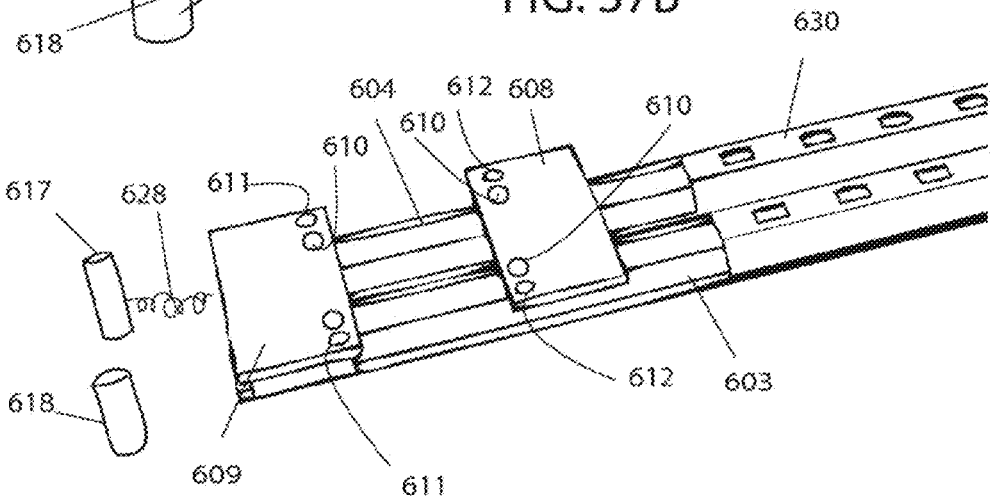

VARIABLE CONFIGURATION BLINDS

RELATED APPLICATIONS

This application claims the benefit of U.S. provisional application Ser. No. 61/610,989 filed on Mar. 14, 2012 under 35 USC 119(e). That application is hereby incorporated herein in its entirety.

FIELD

This disclosure relates to slatted blinds for covering architectural openings.

BACKGROUND

Window blinds and shades satisfy both a functional and a decorative purpose. Some of the most popular blind and shade designs in use have their origins in antiquity. The Romans presumably had roman shades and venetian blinds were known as "Persian blinds" to the Venetians.

Horizontal and vertical slatted shutters and blinds are tiltable to adjust the view and the amount and quality of light transmitted. Additionally, venetian blinds, roman blinds, and others are readily raised and lowered. These variable states provide a variety of degrees of visibility through architectural openings, a varying degree of light transmission, and provide a variable esthetic effect.

The states a blind may assume and the corresponding light allowance regions and overall visual effect have been largely unchanged for many of years. What is needed are devices and methods for producing blind systems with a wider variety of visual states.

SUMMARY

A blinds system for an opening can have subsets of slats with distinct positional control. Relative slat repositioning can be between odd and even numbered slats with movement being horizontal, vertical, or both. With overlapped slats, this selected positioning can hide and expose slat portions and also expose and hide voids between slats. The slat shape can be rectangular or can be other shapes including a scalloped shape.

BRIEF OVERVIEW OF THE DRAWINGS

Figure 15A:
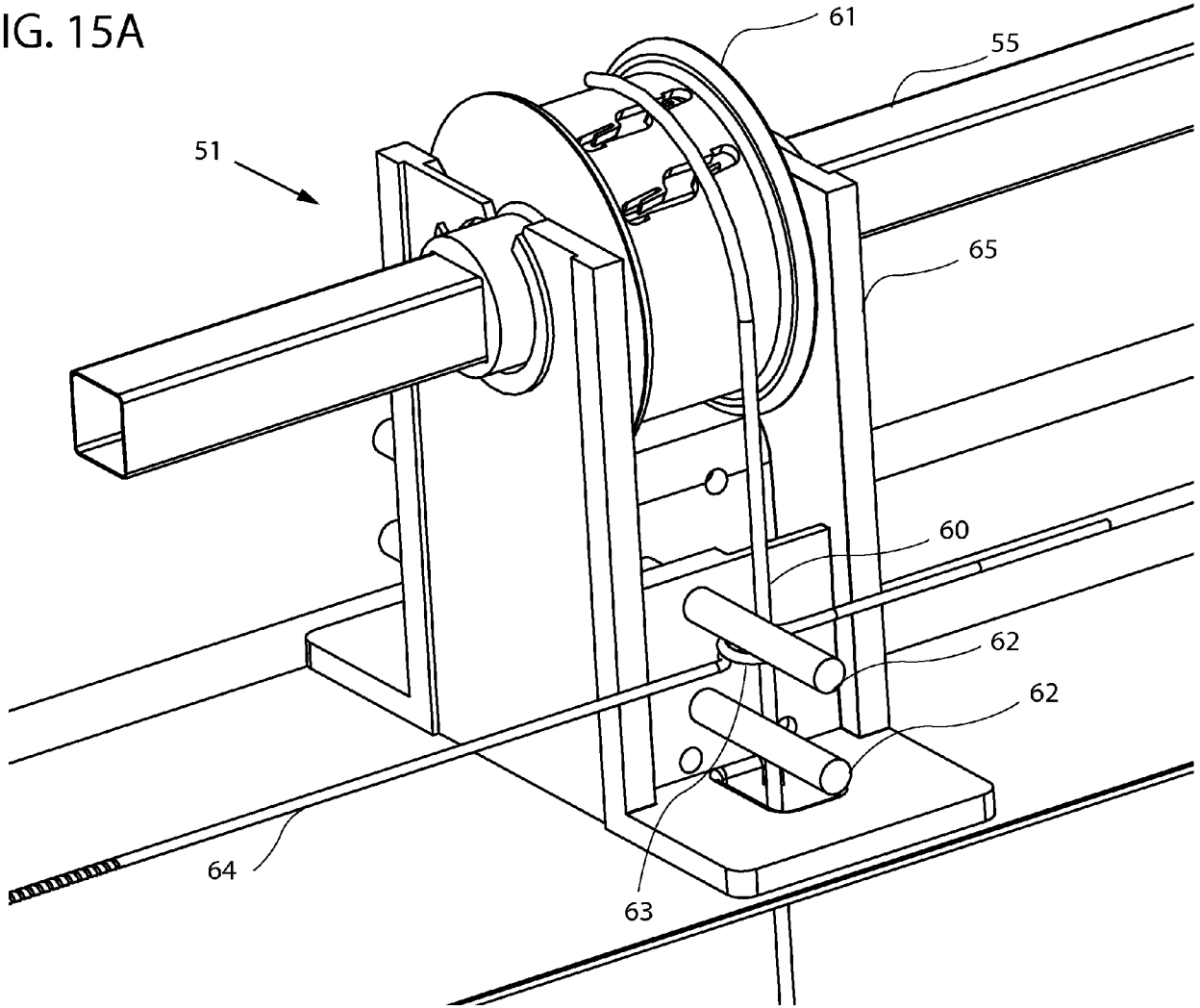
Figure 15B:
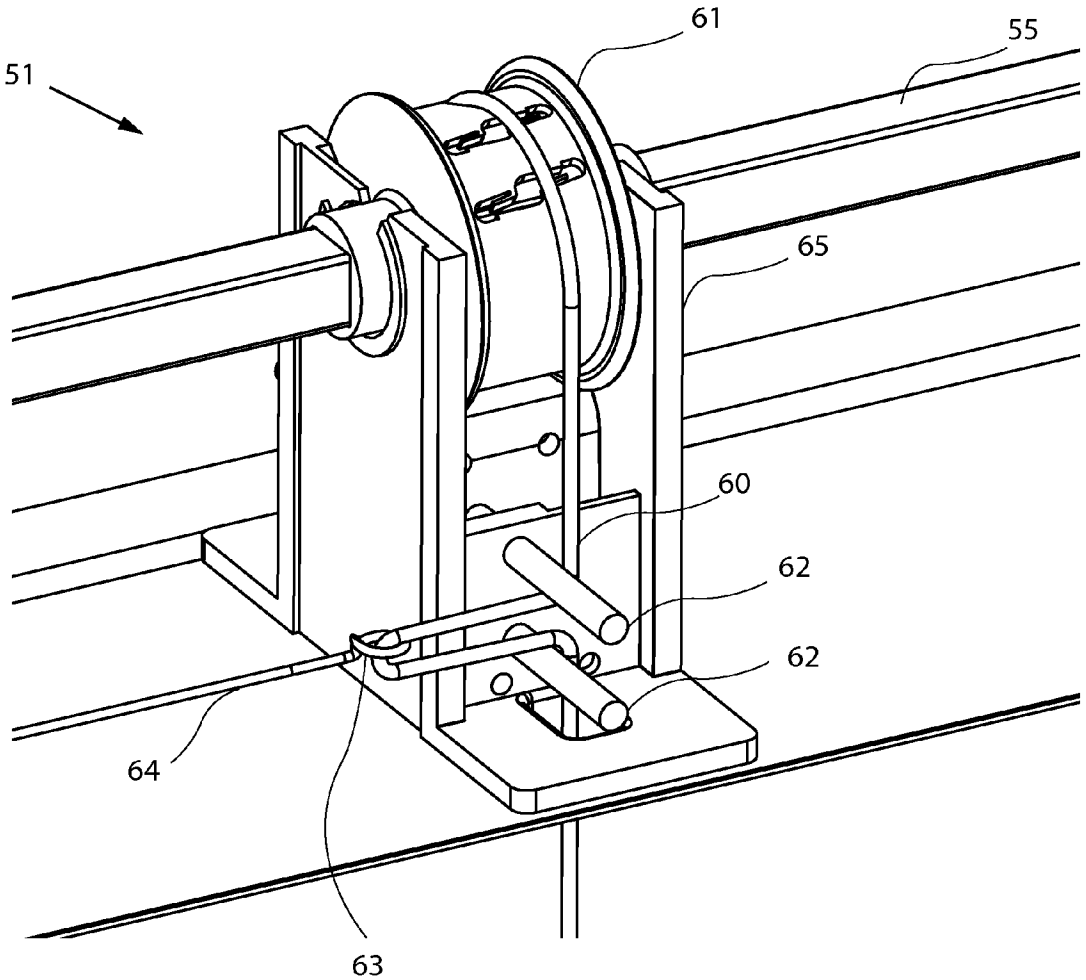
Figure 16:
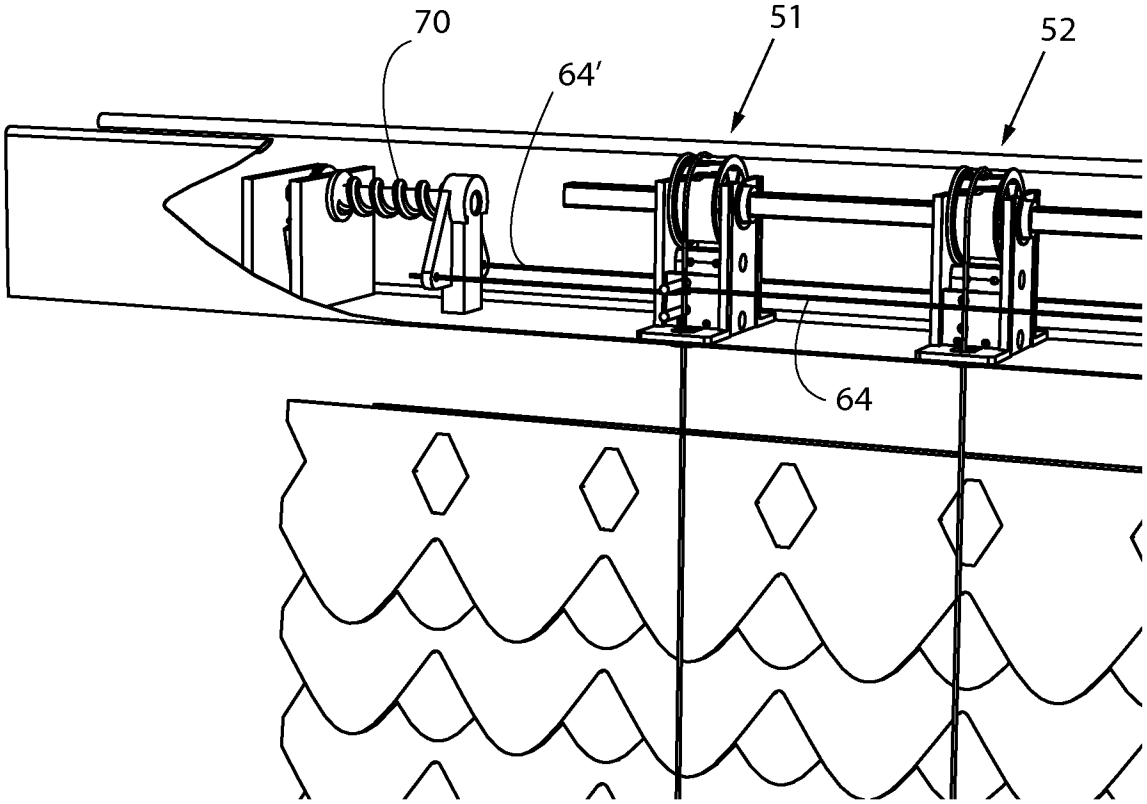
Figure 17A:
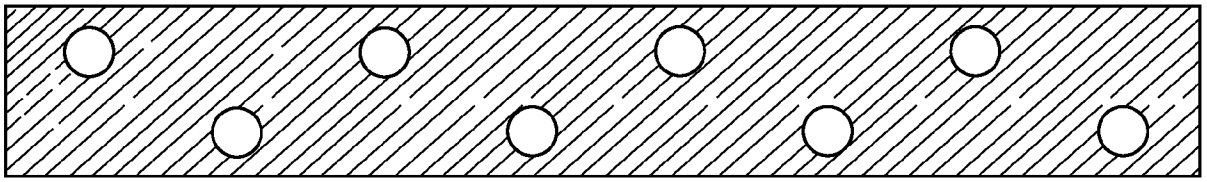
Figure 17B:
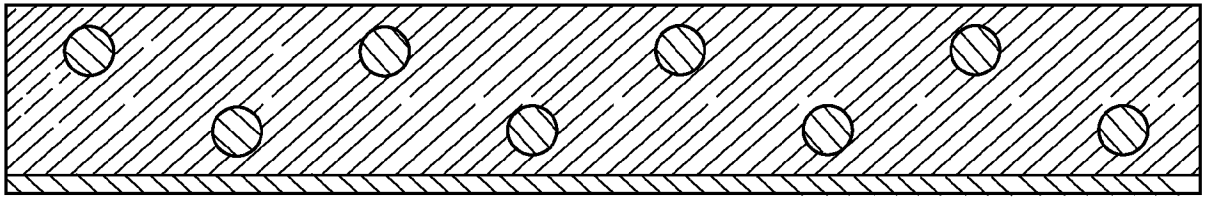
Figure 17C:
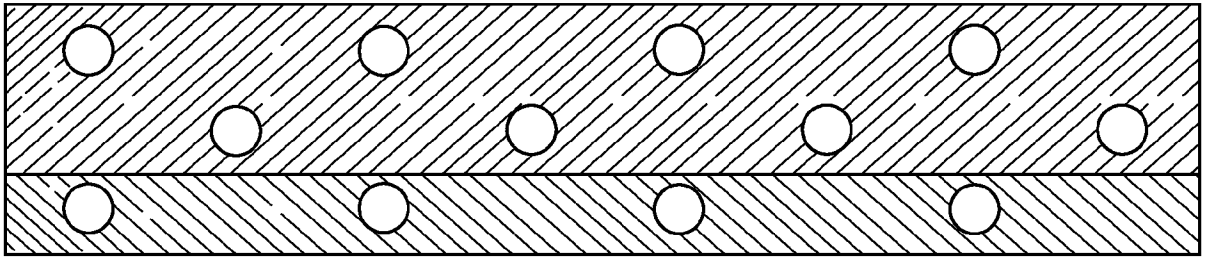
Figure 18:
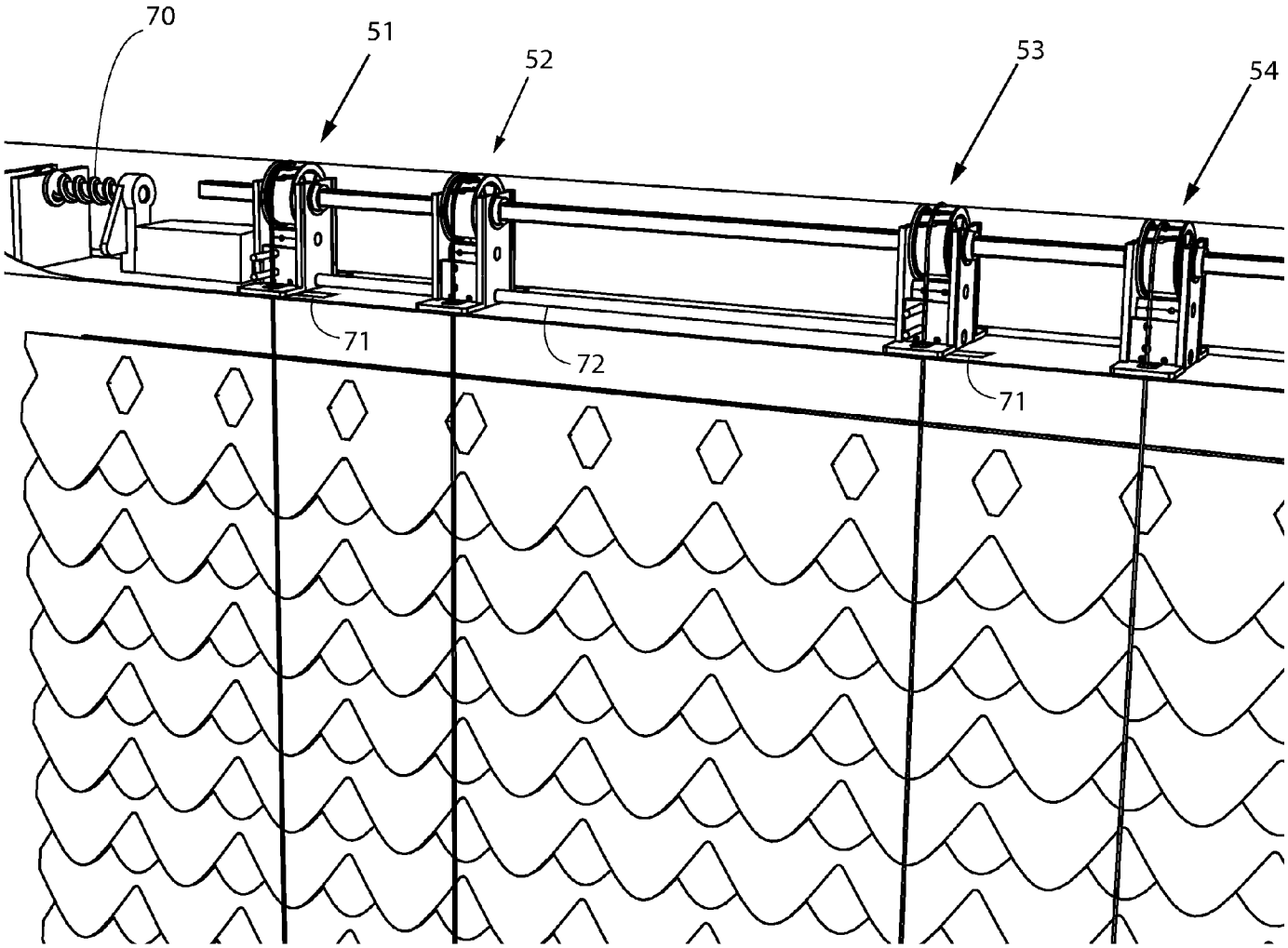
Figure 19:
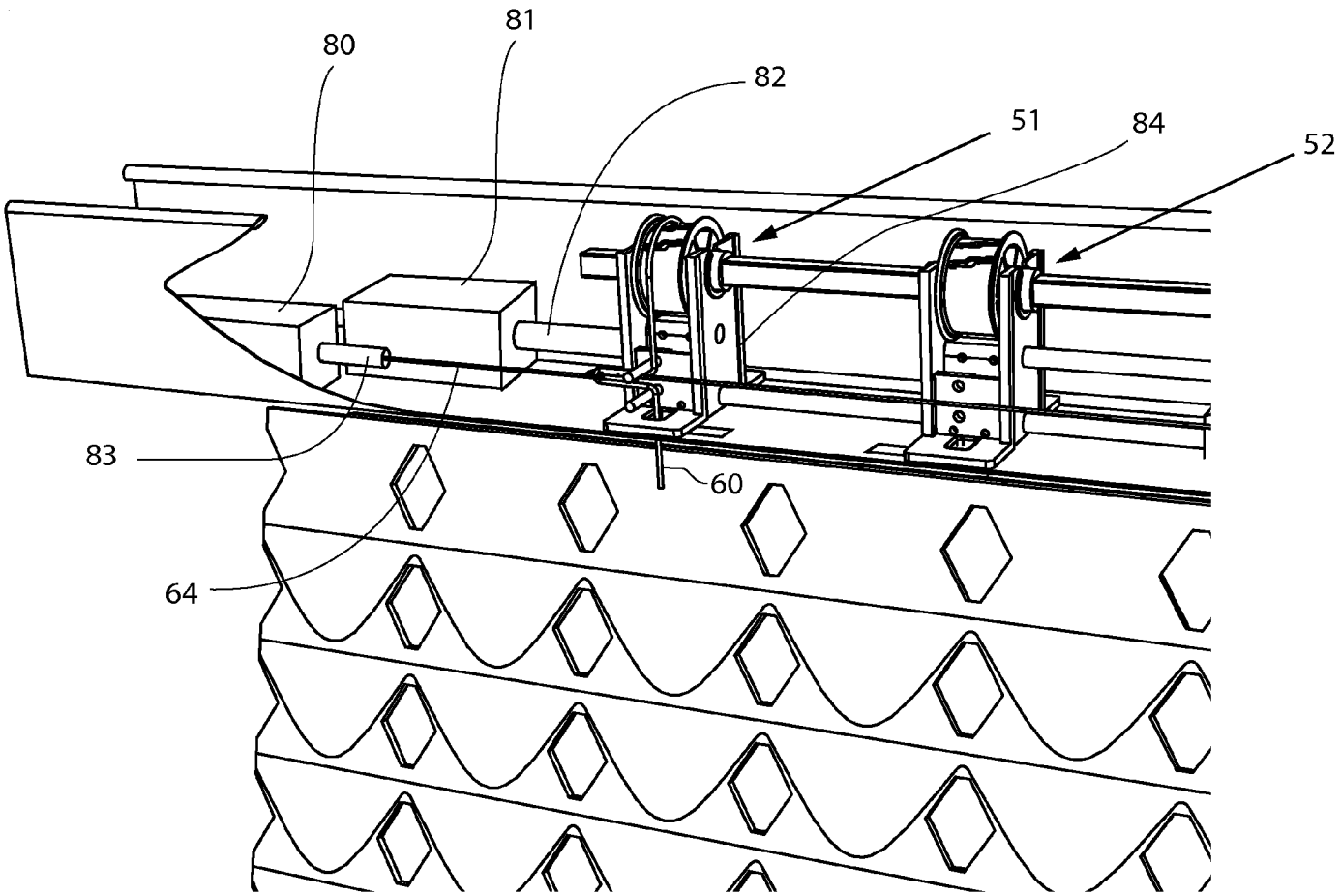
Figure 20:
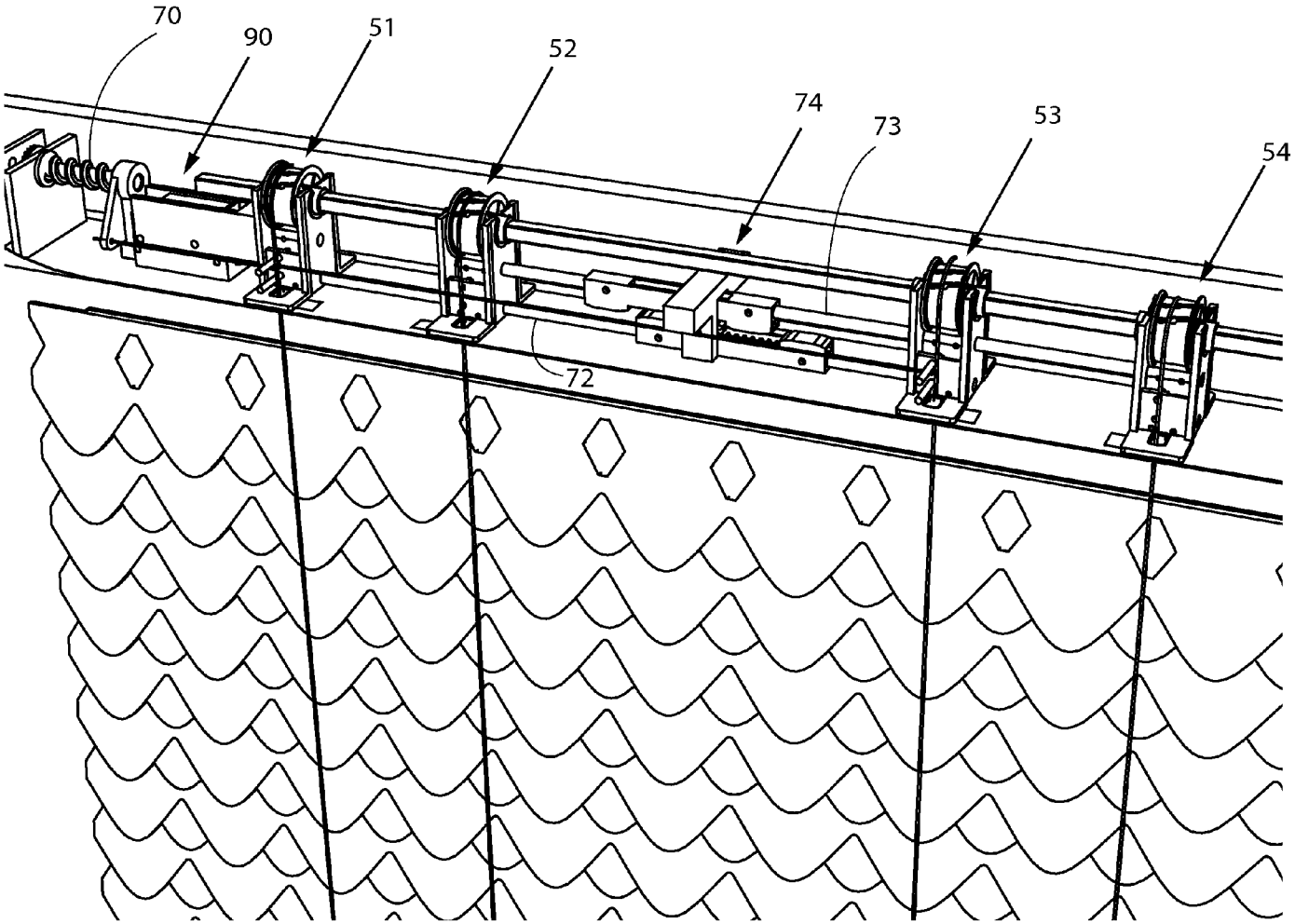
Figure 21:
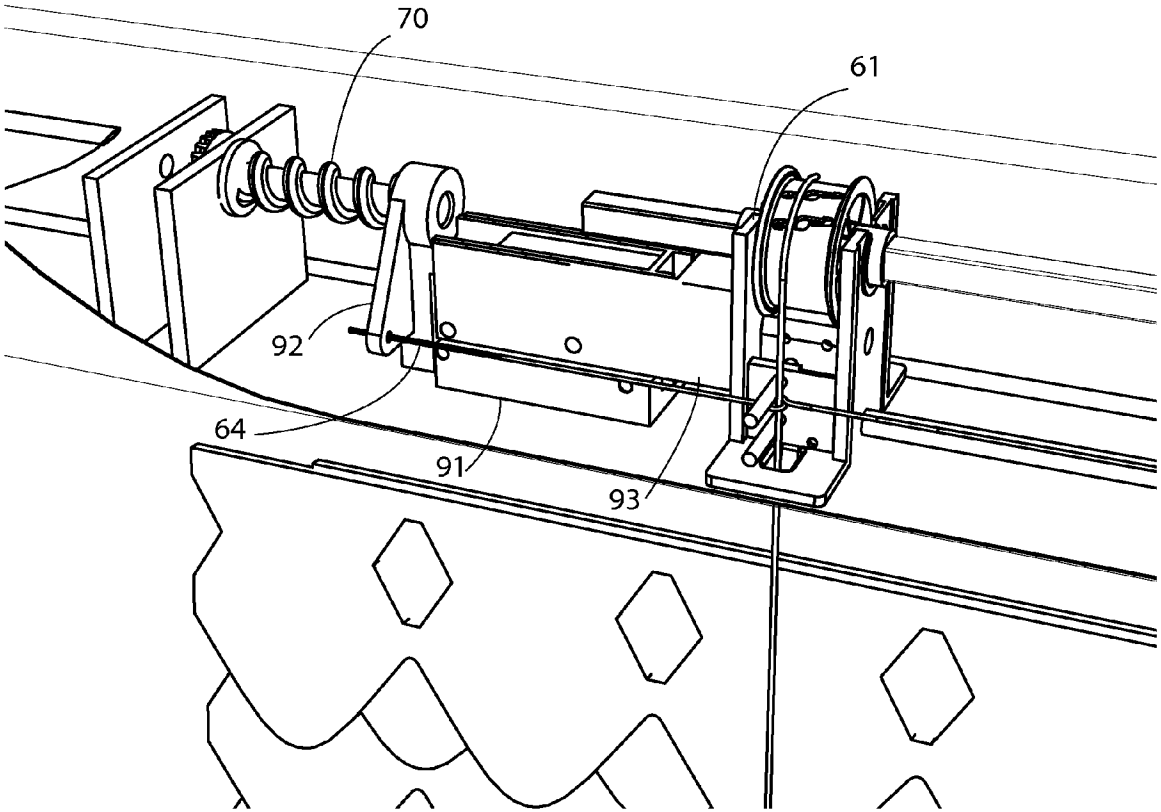
Figure 22:
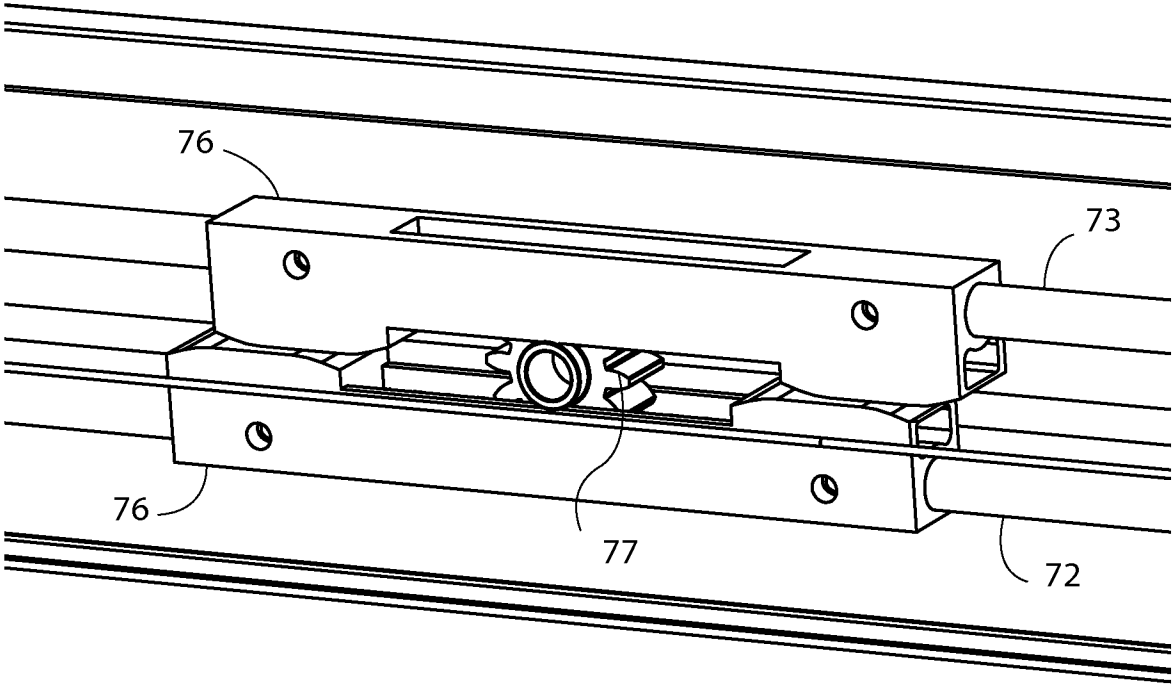
Figure 23:
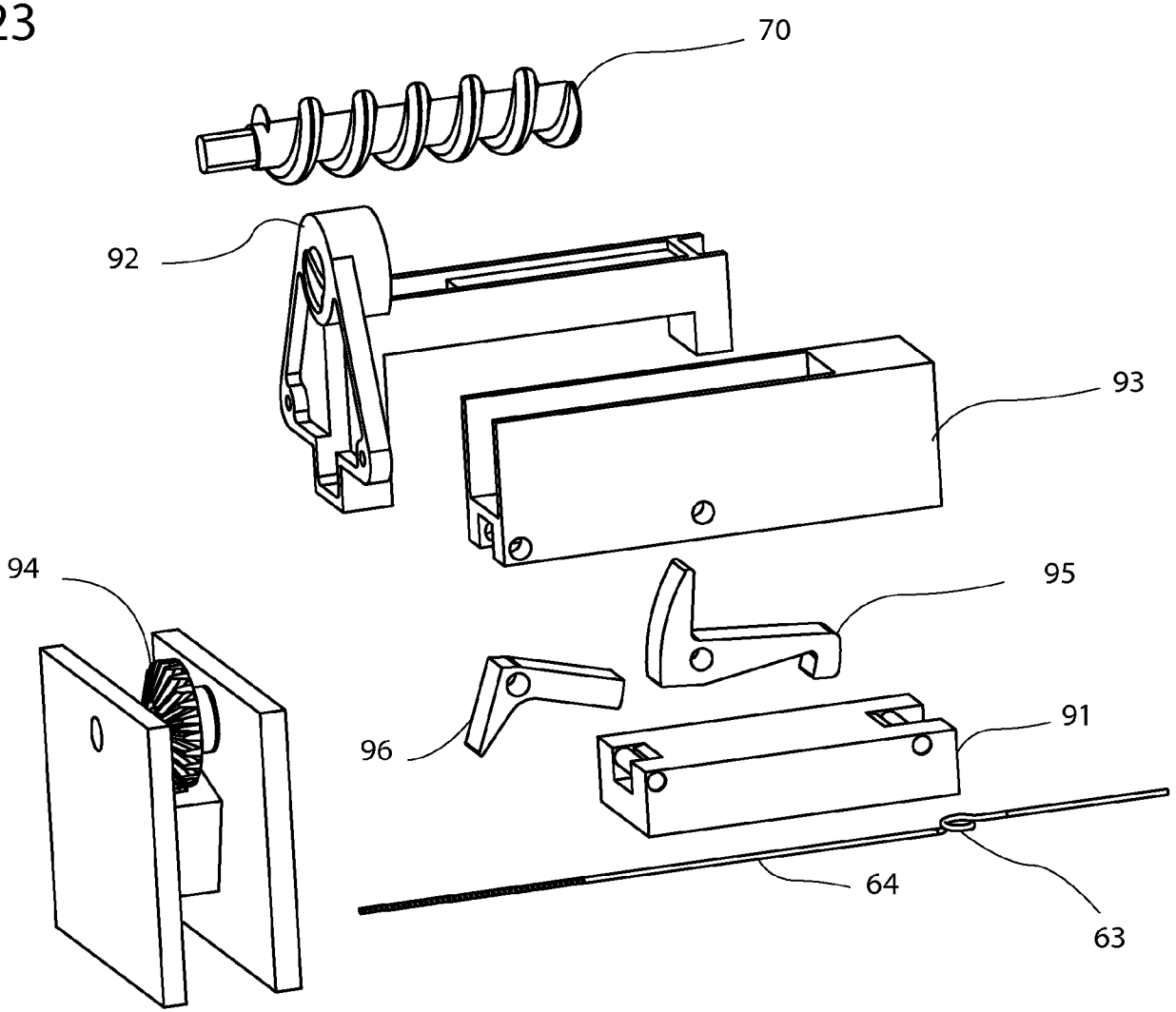
Figure 24C:
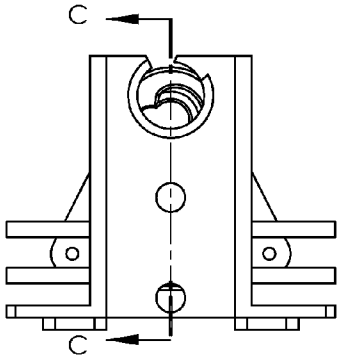
Figure 24A:
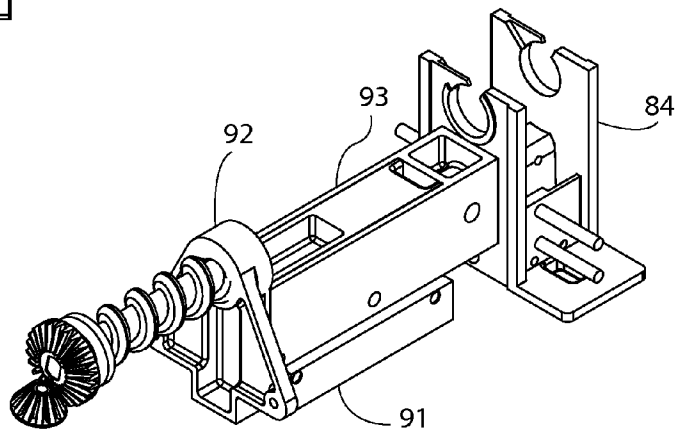
Figure 24B:
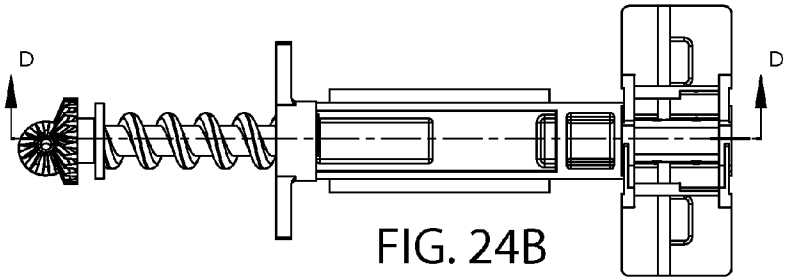
Figure 24F:
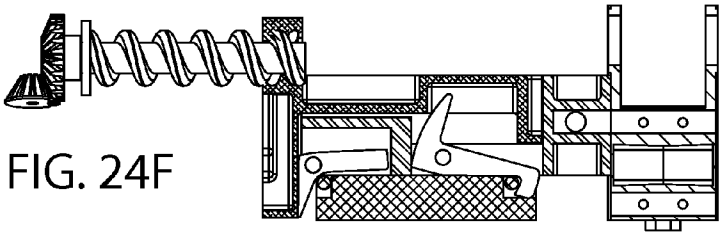
Figure 24D:
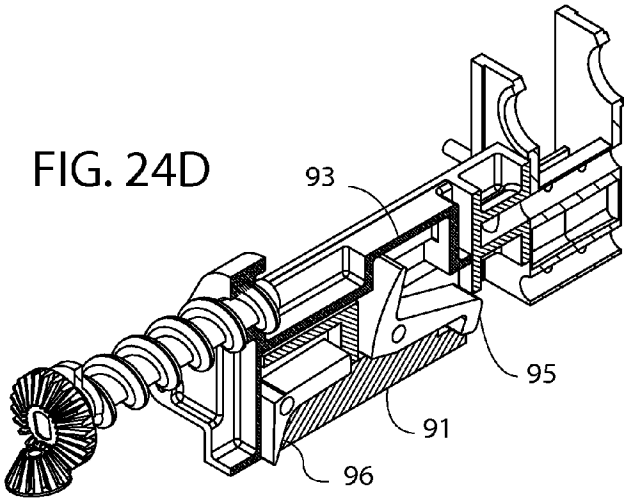
Figure 24E:
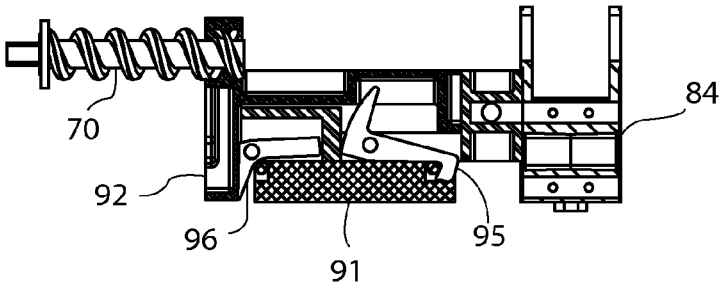
Figure 25:
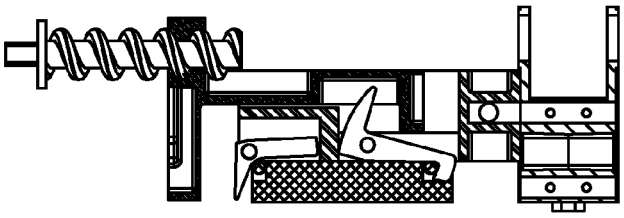
Figure 26:
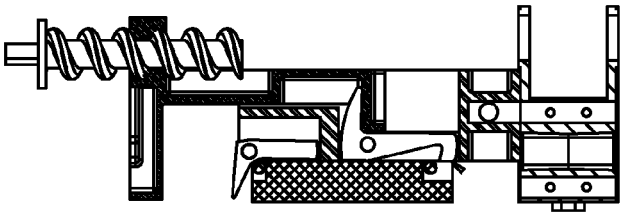
Figure 27:
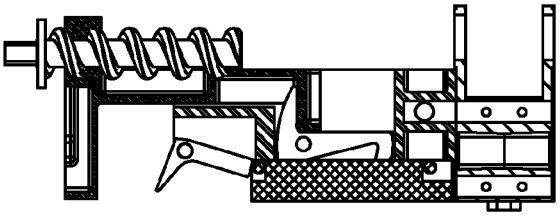
Figure 28:
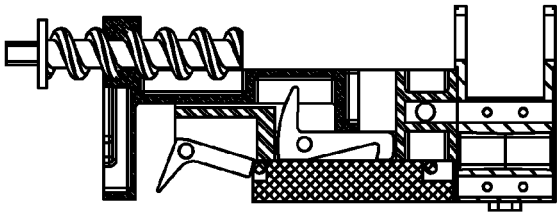
Figure 29:
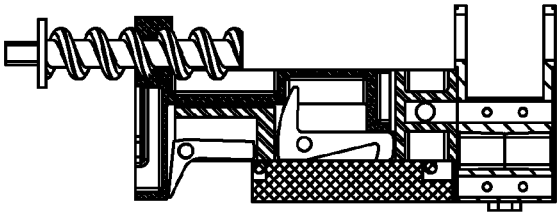
Figure 30:
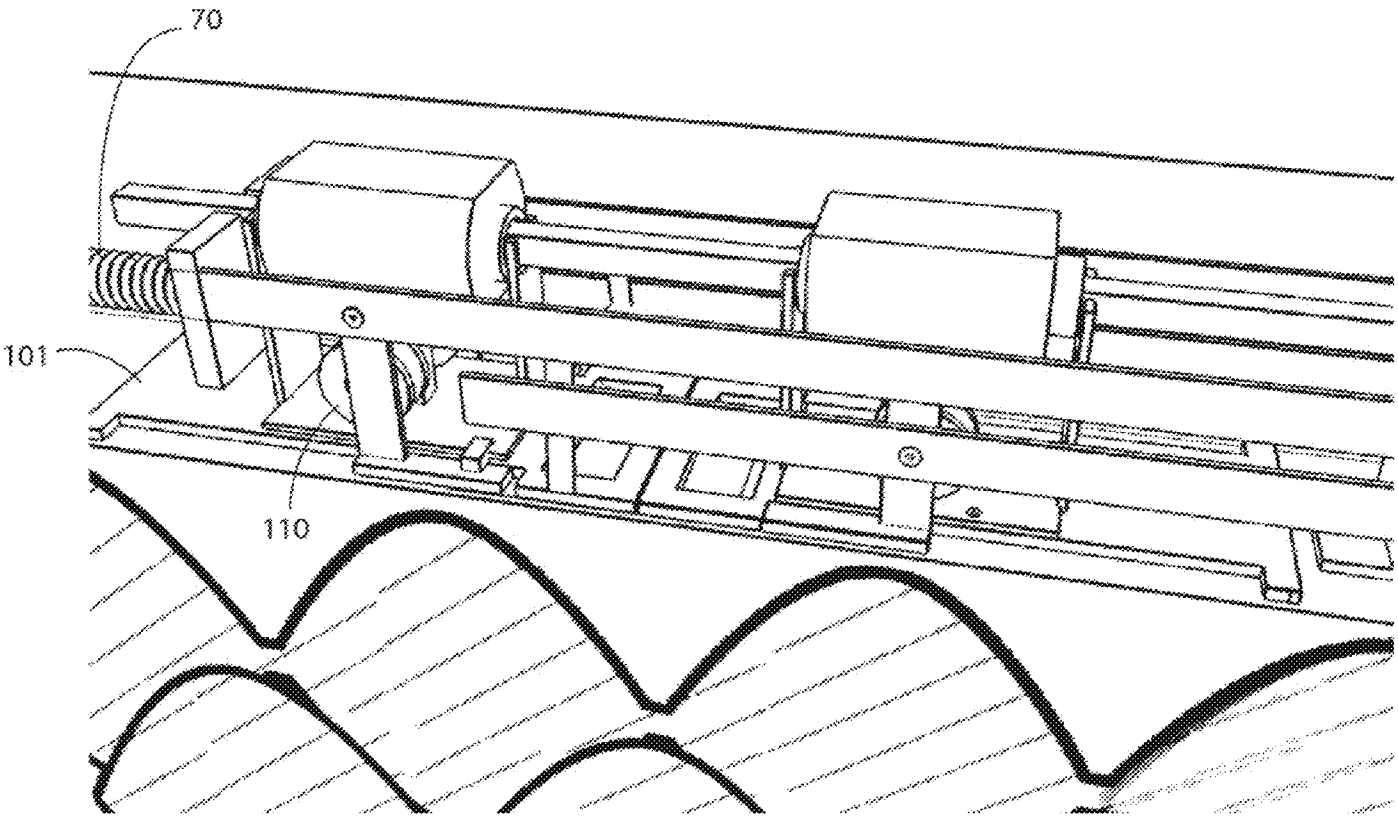
Figure 31:
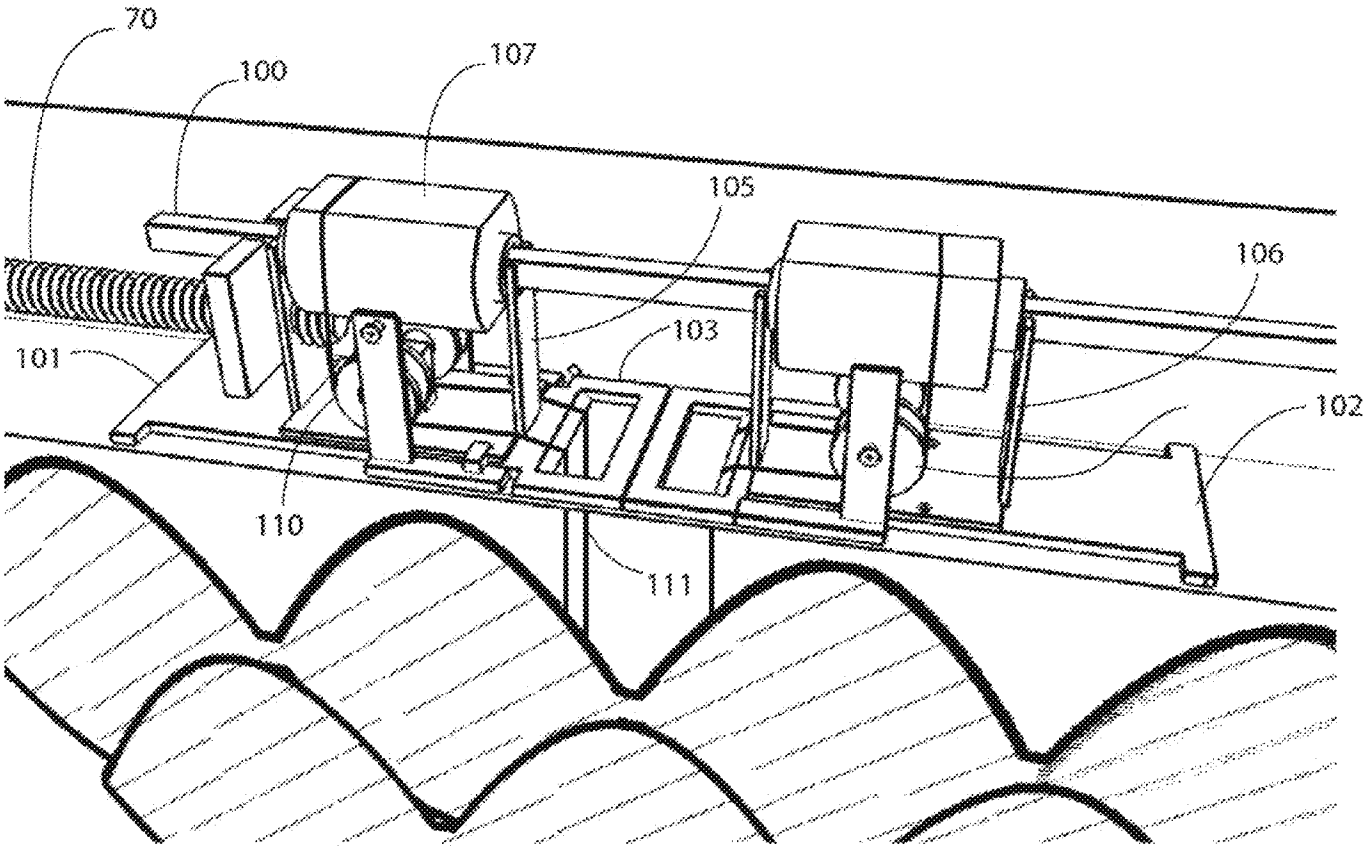
Figure 32:
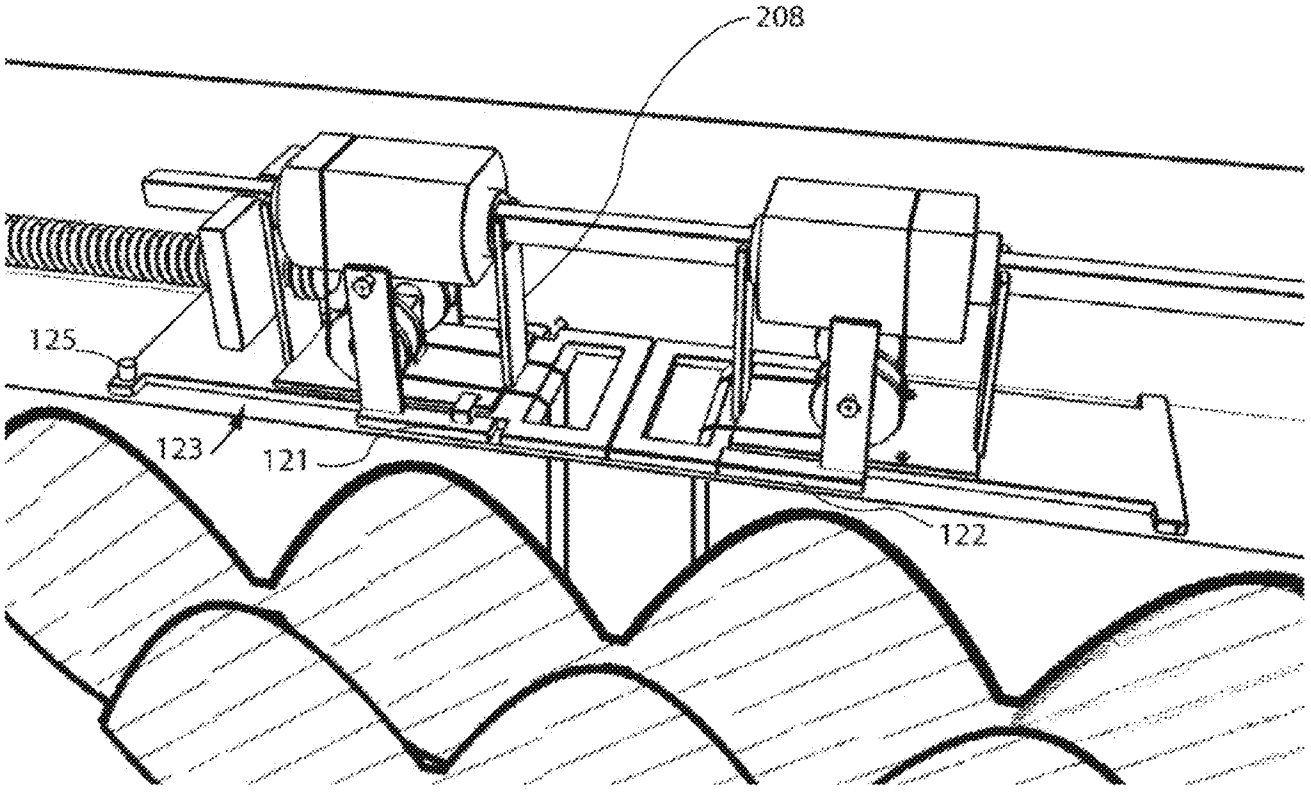
Figure 33:
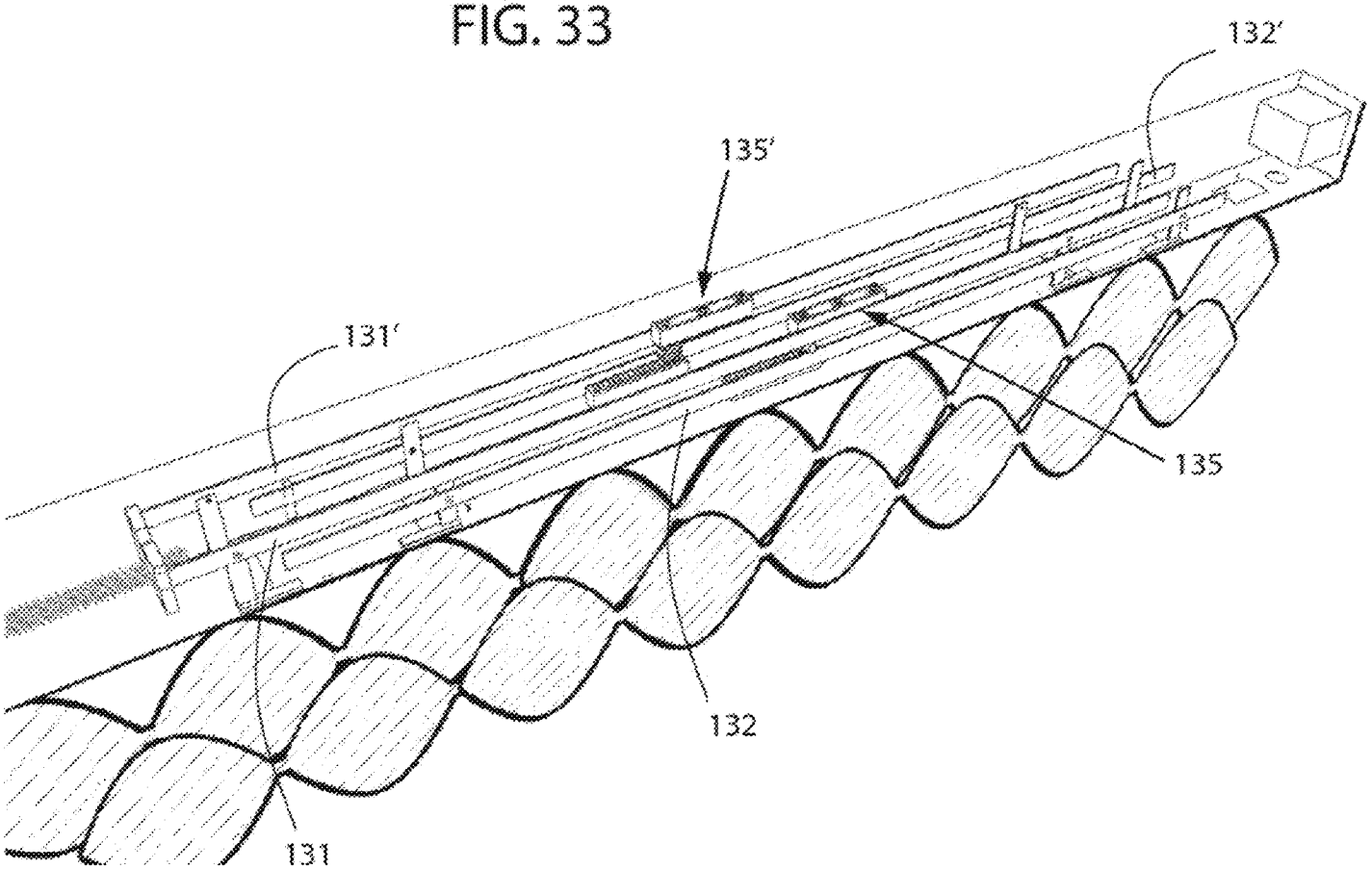
Figure 34:
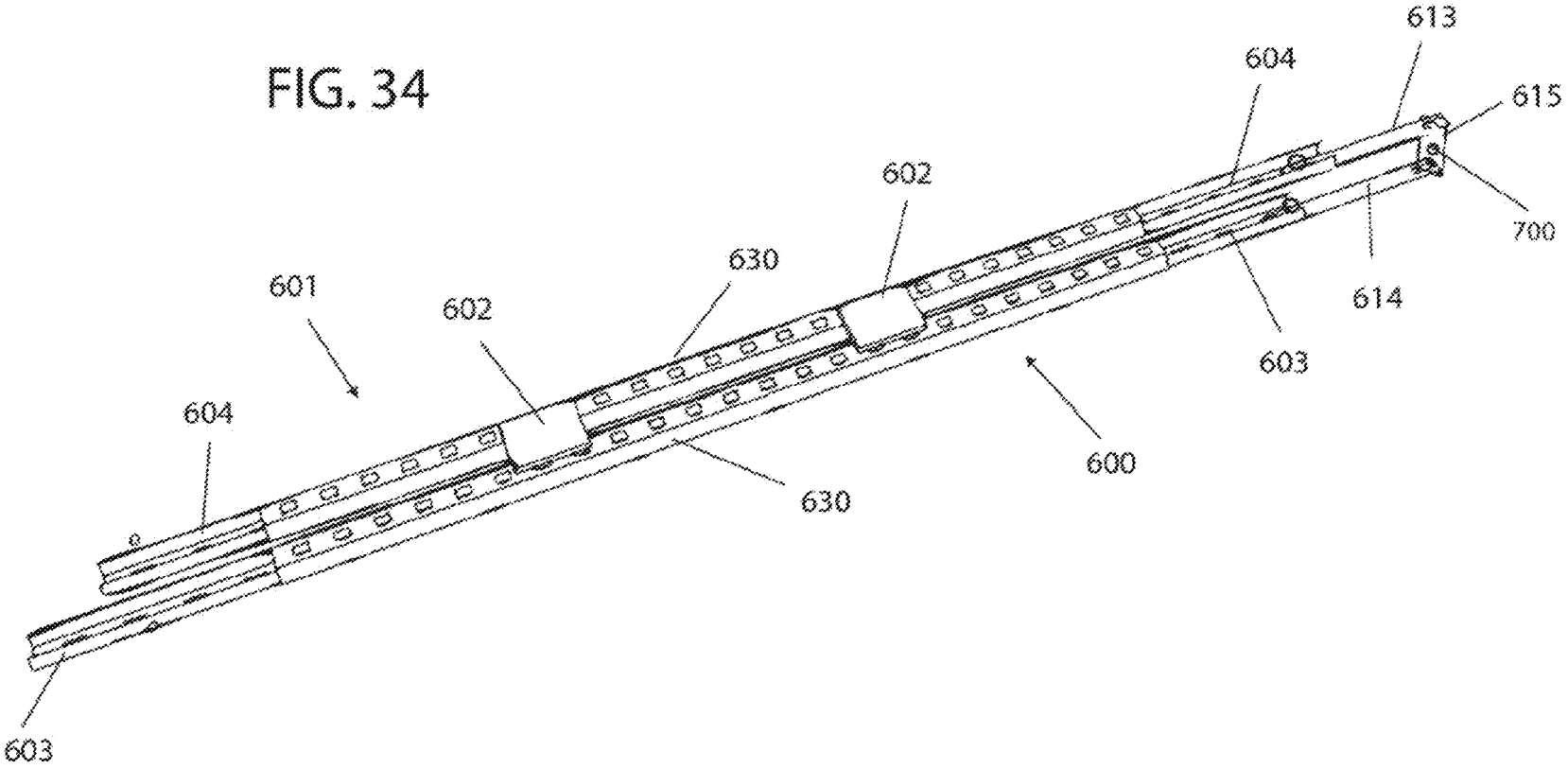
Figure 35A:
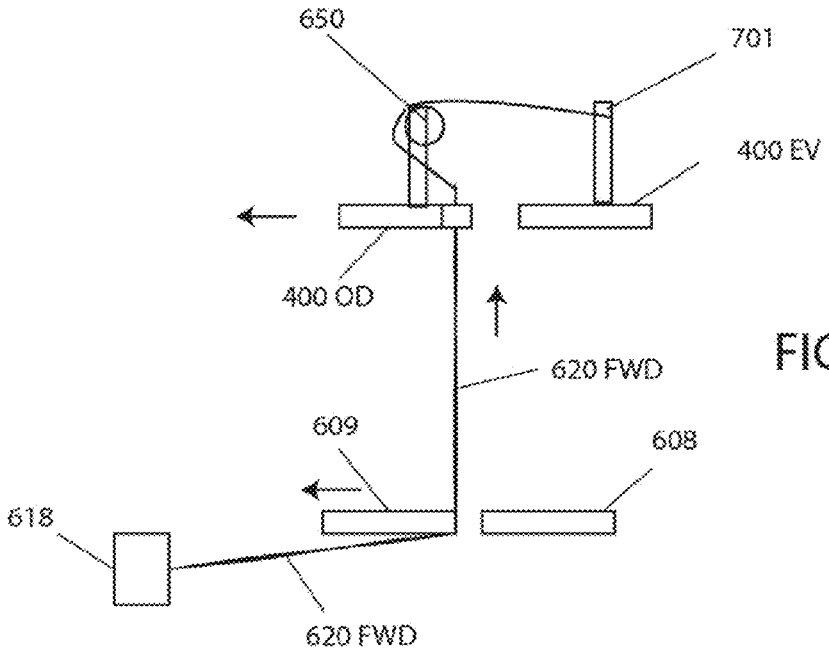
Figure 35B:
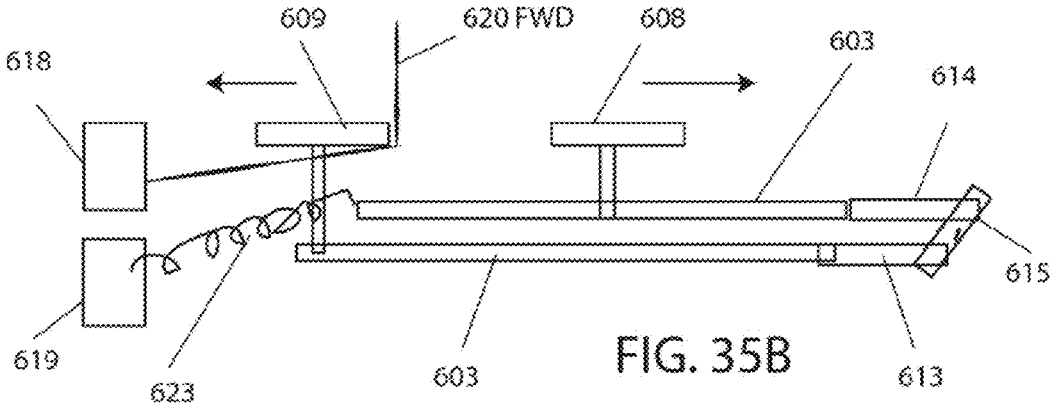
Figure 36A:
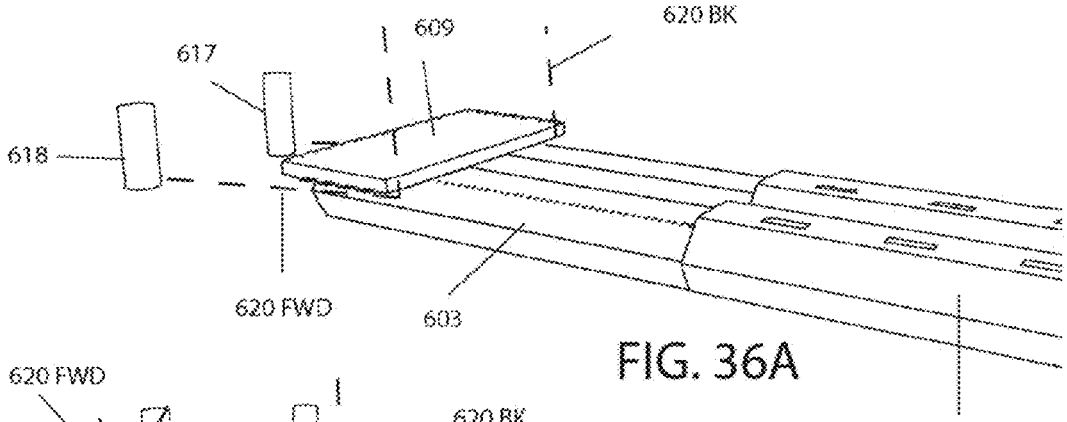
Figure 36B:
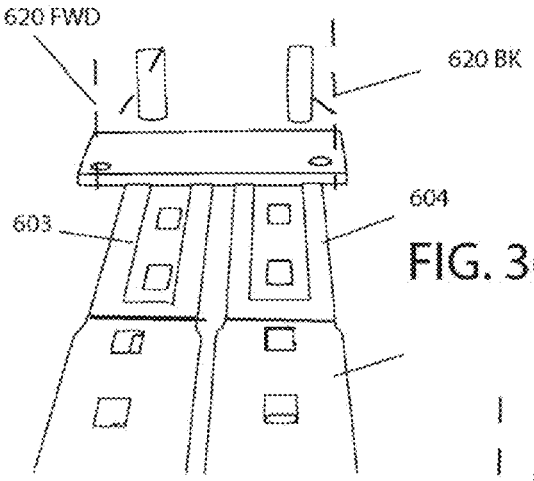
Figure 36C:
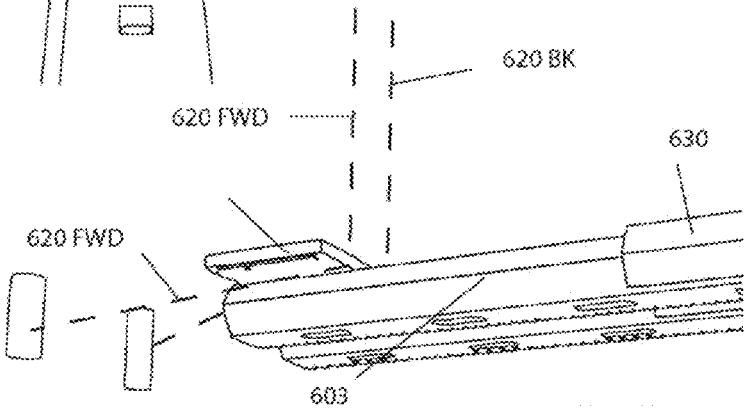
Figure 38:
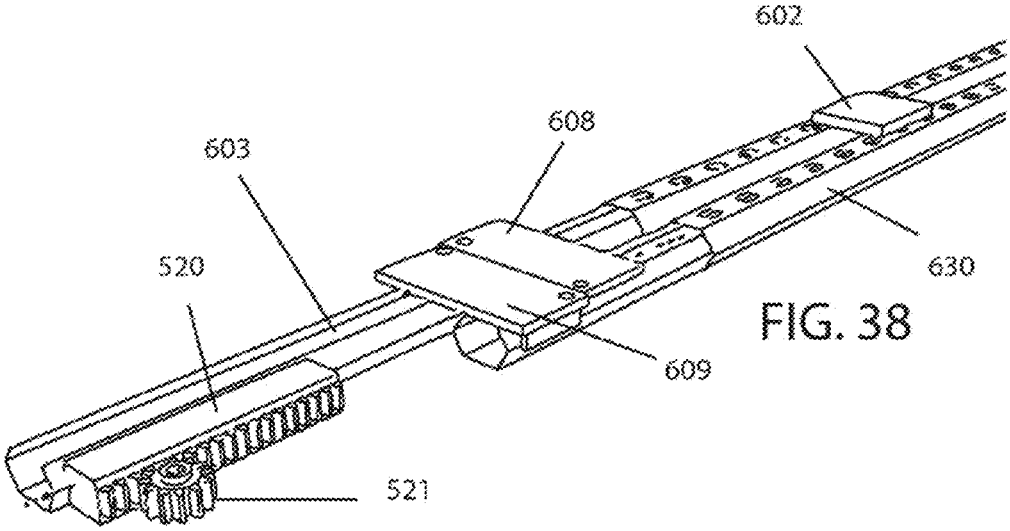
Figure 39:
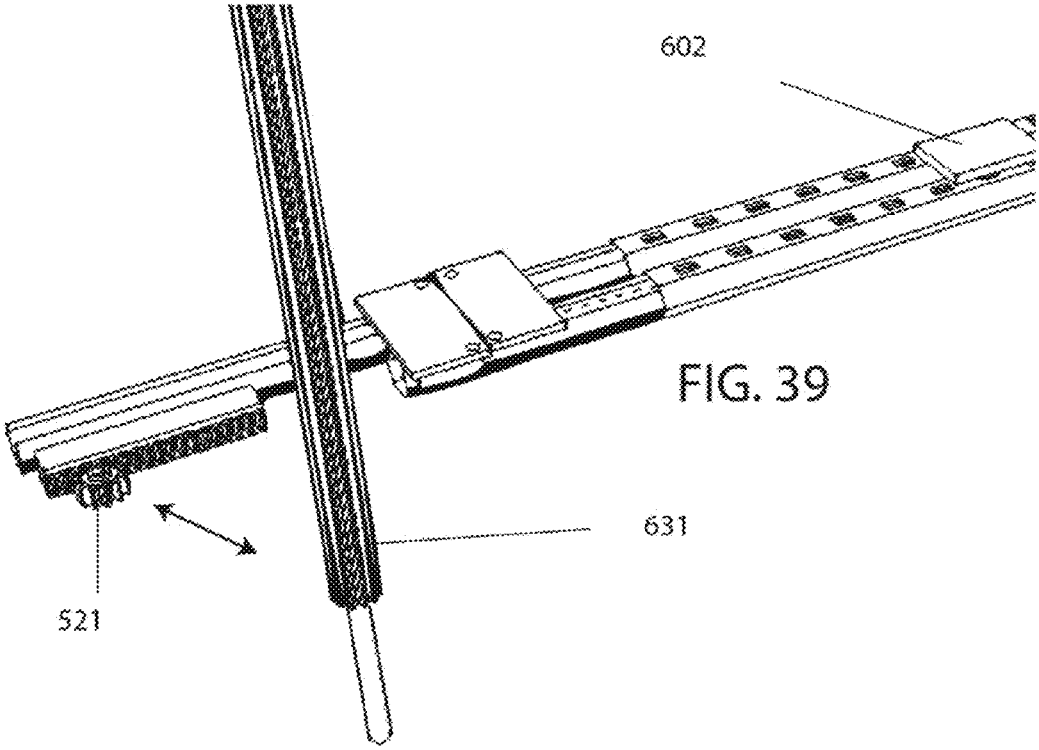
Figure 40:
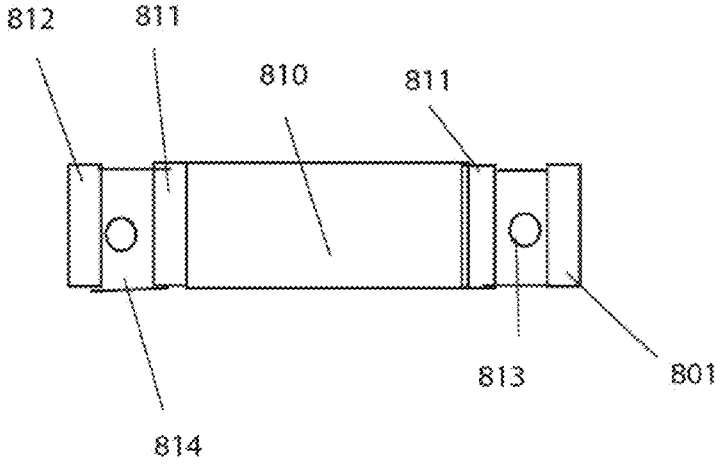
Figure 45:
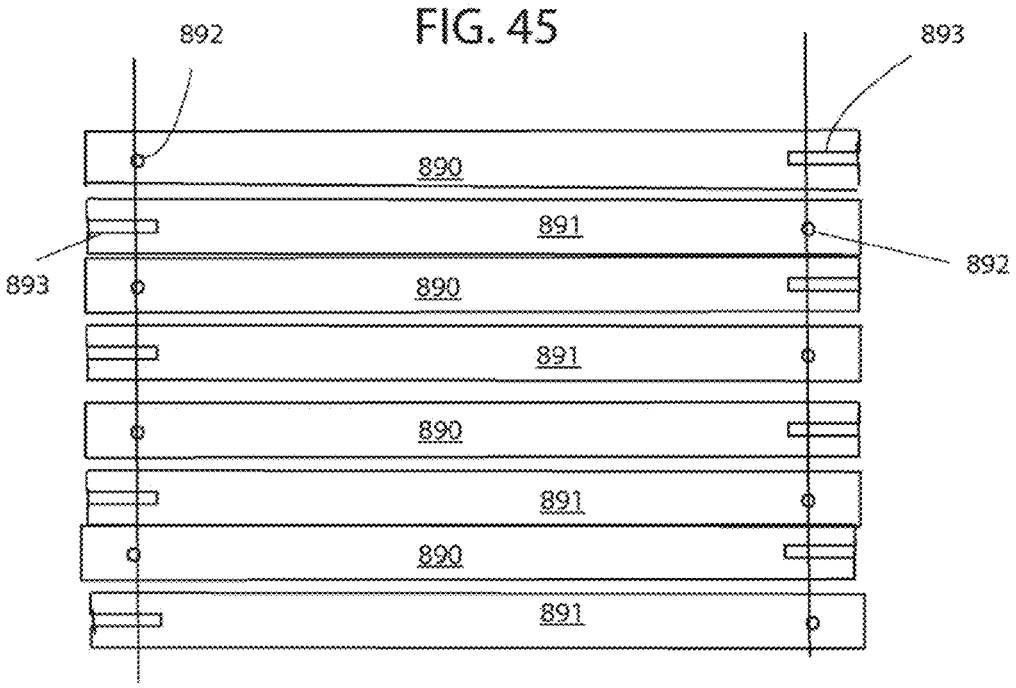
Figure 46:
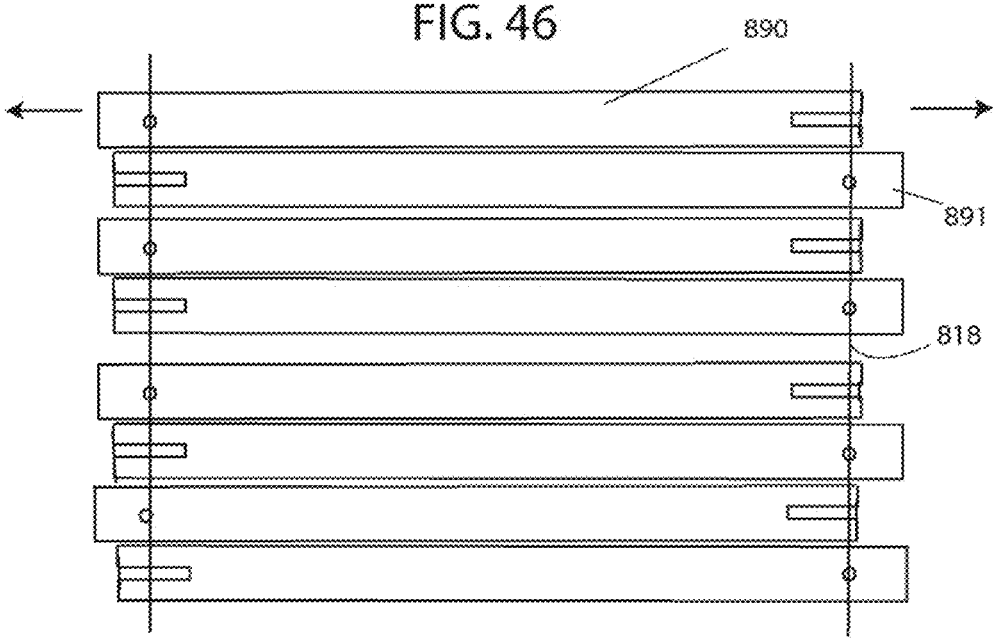
Figure 47:
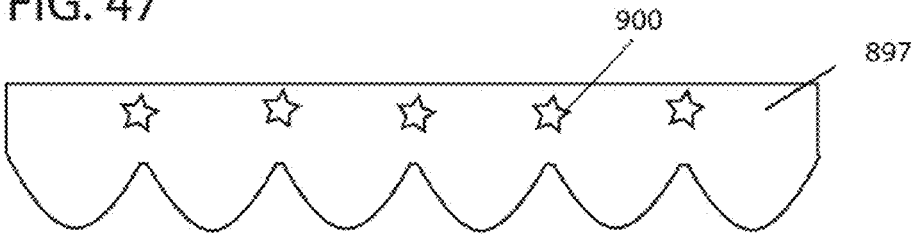
Figure 48:
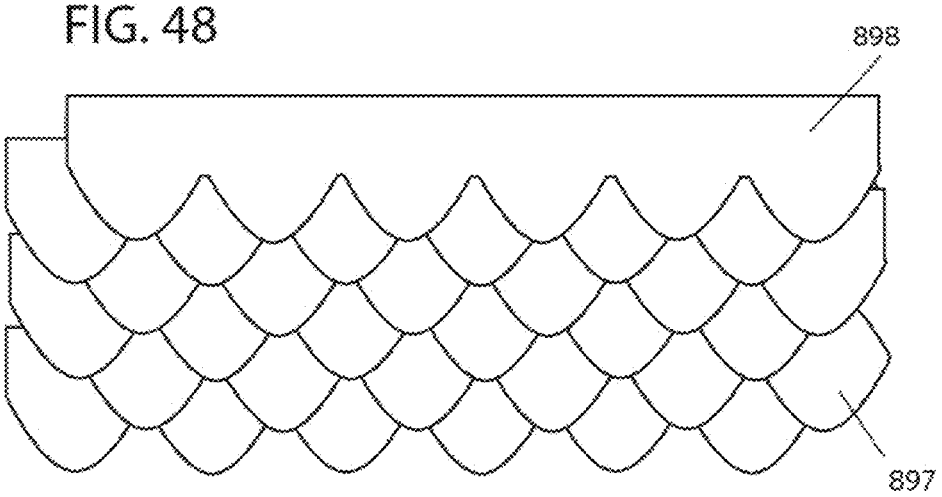
Figure 49:
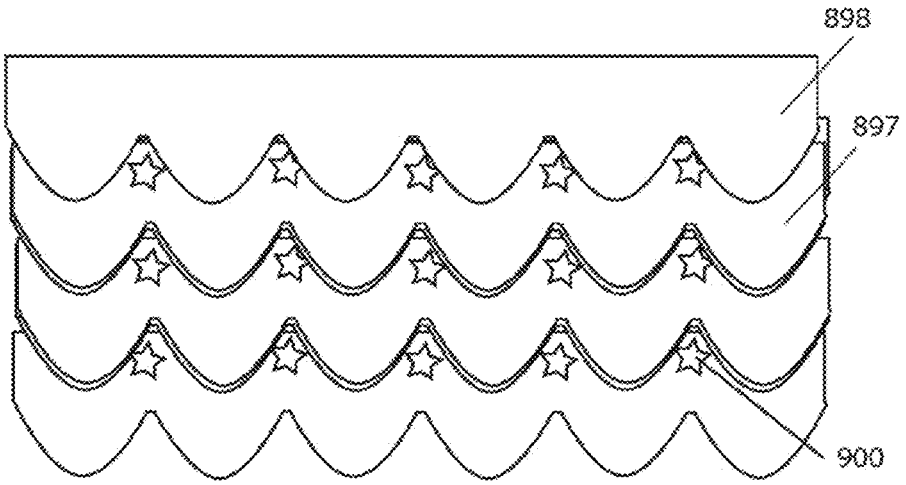

FIG. 15 A shows an enlarged view of a cord support with a cord diversion hook in a neutral position;

FIG. 15B shows the view of FIG. 15A with the cord diverted by the hook system;

FIG. 16 shows a head rail and slats of an up/down only system;

FIG. 17A, FIG. 17B and FIG. 17C show views of a rectangular slat with rows of circular openings; 17A shows a single slat, 17B shows overlapping slats and 17C shows the slats with a partial overlap allowing light passage;

FIG. 18 shows a head rail and slats of a system that supports left/right movement by only moving the odd cord supports;

FIG. 19 shows a portion of a head rail and slats for a combined horizontal and vertical positioning system with separate linear motors;

FIG. 20 shows a head rail and slat system with an integrated mechanical operating system;

FIG. 21 shows an enlarged view of the operating system of the unit of FIG. 20;

FIG. 22 shows an enlarged, isolated, partial view of a reversing system;

FIG. 23 shows an exploded view of the unit of FIG. 20;

FIG. 24A shows a perspective view of a mechanical binds operating system in an initial closed/down state;

FIG. 24B shows a plan view of the unit of FIG. 24A in the same state;

FIG. 24C shows a side view of the unit of FIG. 24A in the same state;

FIG. 24D is a perspective sectional view, taken along D-D of FIG. 24B;

FIG. 24E is a front perspective sectional view, taken along D-D of FIG. 24B;

FIG. 24F is FIG. 24E enlarged;

FIG. 25 is a front sectional view of the unit of FIG. 24A in a state of closed/½ up;

FIG. 26 shows the unit and view of FIG. 25 with the mechanism in the state of closed/up;

FIG. 27 shows the unit and view of FIG. 25 with the mechanism in the state of open/up;

FIG. 28 shows the unit and view of FIG. 25 with the mechanism in the state of open/½ down;

FIG. 29 shows the unit and view of FIG. 25 with the mechanism in the state of open/down;

FIG. 30 shows a perspective of an alternate lost motion cord control scheme;

FIG. 31 is the unit, configuration and view of FIG. 30 with linkage bars removed for clarity;

FIG. 32 is the unit of FIG. 30 with the odd barrel guide and barrel moved leftward to raise the odd slats;

FIG. 33 is an odd/even cord support movement constraint system with front and rear linkages, may be adapted for use in several of the embodiments herein;

FIG. 34 shows the odd and even slider assemblies of an active bottom rail;

FIG. 35A is a simplified schematic of the operation of motion of the left odd cord support on the head rail moving the left odd carriages of the bottom rail;

FIG. 35B is a schematic of the operation of motion of the carriages of the bottom rail;

FIGS. 36A, 36B, and 36C, are enlarged partial views of the left end of the bottom rail mechanism;

FIG. 37A is an upper perspective view of the left end of the bottom rail mechanism with control cords and lift cords shown; ladders are not shown;

FIG. 37B is a higher perspective view of the apparatus of FIG. 54A without cords;

FIG. 38 shows an alternative bottom rail assembly that is operated by a gear-rod wand;

FIG. 39 is another view of the bottom rail mechanism operated by a gear-rod wand showing the wand;

FIG. 40 is a plan view of a tape ladder with a hidden pair of cords;

FIGS. 41, 42, 43, and 44, show an alternative ladder control system in various mode states;

FIG. 45 and FIG. 46 show front views of an alternate odd/even blinds system with lift cords at the outside left and outside right ends of the slats;

FIG. 47 shows a slat with a straight upper edge and a scalloped lower edge; a star design is repeated horizontally;

FIG. 48 shows a blinds system using several slats of FIG. 47 in an overlapped position;

FIG. 49 shows a blinds system with the slats of FIG. 48 with odd slats moved left and therefore upward exposing the star design.

DETAILED DESCRIPTION

Introduction

Several embodiments of slatted blinds and blind systems are described where subsets of the slats have independent suspension allowing independent horizontal and vertical translation control distinct from other intermingled subsets of the slats. Generally, horizontal blinds have two degrees of freedom of motion. One is tilting with the slats rotating in place in unison. The other is raising the slats with a lower contiguous portion of the slats collapsing by upward movement and resting flat on one another in planes approximately perpendicular with the plane of the opening the blinds might be covering.

Many of the embodiments described below allow two other degrees of movement. In these embodiments, a subset of slats can move in concert in a left/right direction relative to other intermingled slats. The second new degree of motion is that some slats can move in concert in an up/down direction relative to other intermingled slats. Using overlapping and non-overlapping regions, both types of motions can expose and hide slat regions depending upon the relative positions of adjacent slats. This can expose and hide decorative aspects of slats and may also allow and disallow or modify light transmittal through the blinds depending on the configuration of slats. In some embodiments, upper and lower edges of the slats have shapes other than a straight line. Some configurations have odd and even slats separately controlled.

"Two Head Rails" Embodiment

Figure 1:
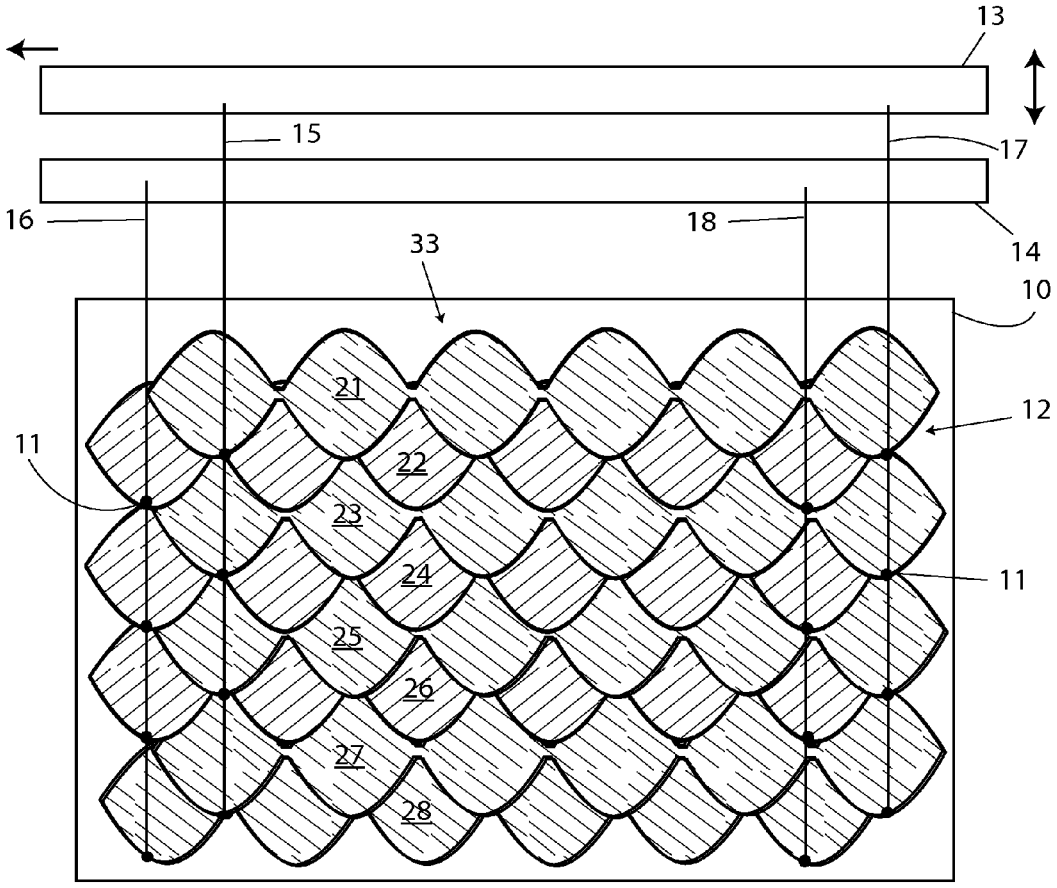
FIG. 1 shows a front view of a window covering system with two head rails, one for the odd slats and the other for even slats; the system is seen in a maximum overlapping slat mode.

FIG. 1 shows a front view of window opening 10 is covered by a set of horizontal slats 12. This embodiment has odd and even slats supported, respectively, by distinct even and odd ladders connected to respective odd 13 and even 14 head rails. The ladders in this specific drawing connect to their respective slats at a point just to one side or the other of the slat's lower peaks, indicated by a dot 11. An upper odd head rail 13 supports a left odd ladder 15 and a right odd ladder 17. A distinct second, lower even head rail 14 supports an even left ladder 16 and even right ladder 18. The odd ladders have rungs that odd slats 21 23 25 27 rest upon. The even slats 22 24 26 28 rest on rungs of the even ladders.

Figure 2:
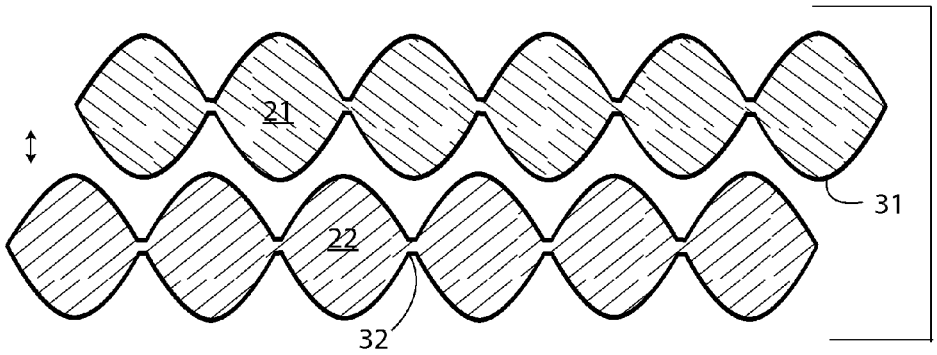
FIG. 2 shows the first two slats of the system of FIG. 1 in isolation and separated vertically.

As seen in FIG. 1, and more clearly in FIG. 2, the slats in this example have a lower edge that might be described as scalloped or a wave shape. There is a considerable overlap of adjacent slats on the order of 50% of the slat height. The odd and even slats are horizontally offset from one another by what can be thought of as one-half of a wavelength of the wave-shaped lower edges. The lower peaks 31 of the odd slats are over the troughs 32 of the even slats and vice versa. This presents an overall visual impression of a scaled, imbricated surface in this positional state or mode. Although the upper edge 33 of the uppermost slat 21 is visible it is the only upper edge visible in this state. The slats have a symmetric shape that includes a wave shaped upper edge as well as lower edge.

Figure 3:
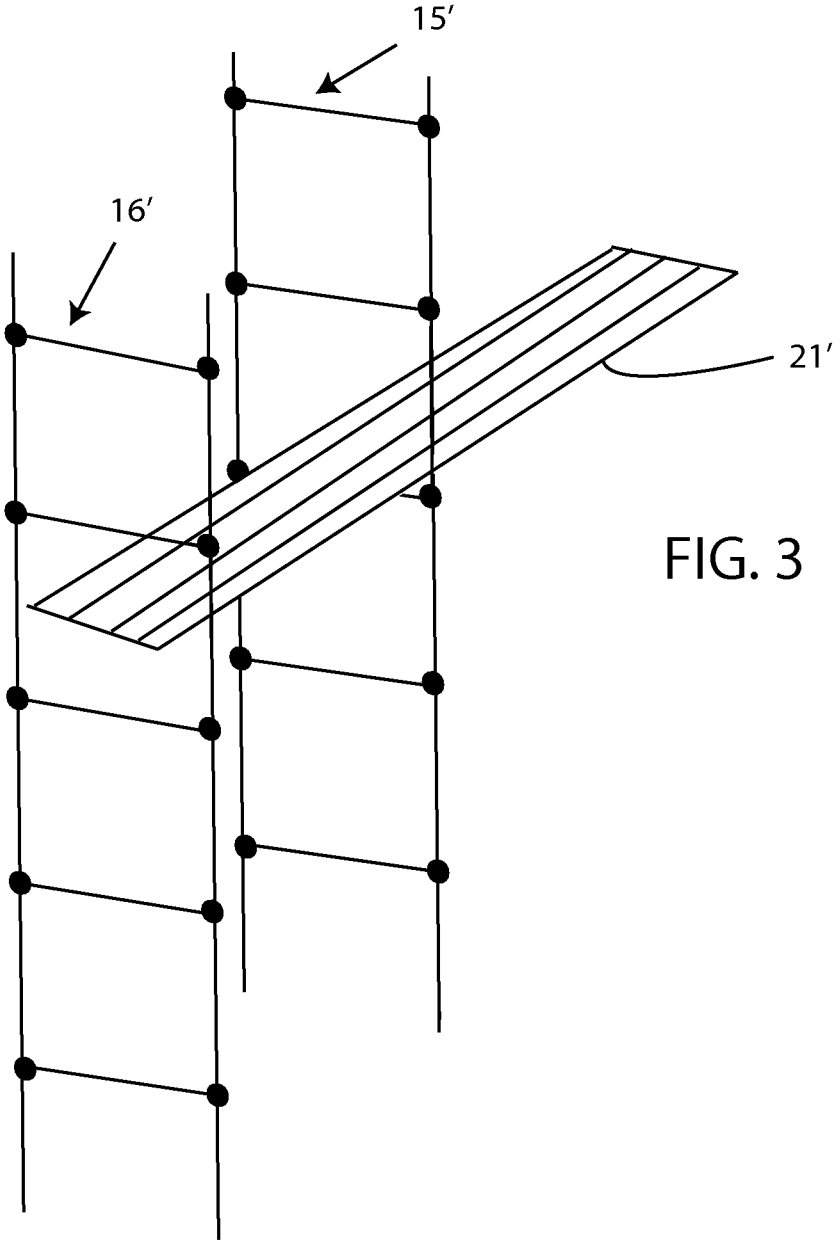
FIG. 3 shows a schematic view of an even blinds ladder and an odd blinds ladder with an odd slat supported by a rung of the odd ladder.

FIG. 3 is a schematic, perspective partial view of part of a blind system similar to FIG. 1 showing only a left odd ladder 15' and a left even ladder 16'. The odd ladder is supporting slat 21'. The ladders are separated from each other for clarity, but may be closer or further spaced.

Figure 4:
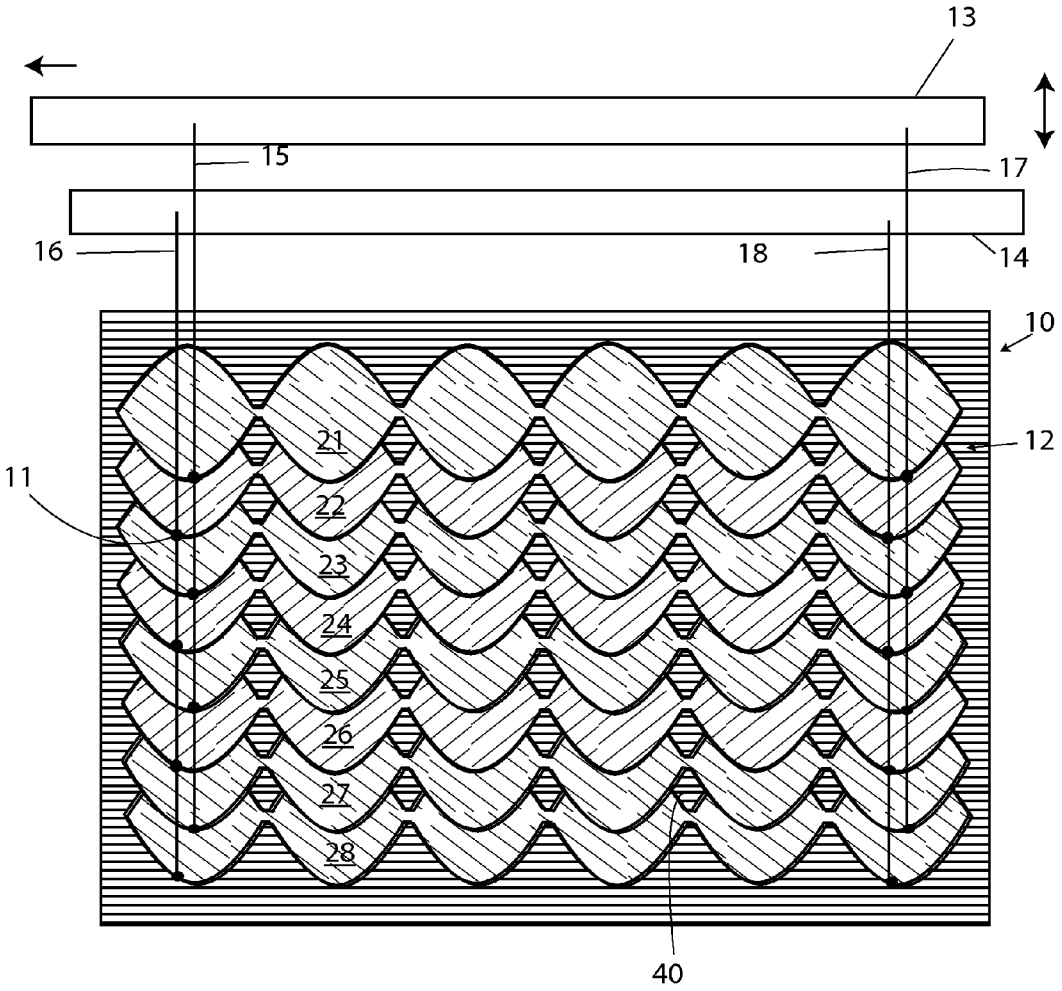
FIG. 4 shows the blinds system of FIG. 1 with the odd head rail moved to the left by an amount that moves the attached odd ladders and supported odd slats an equal amount and aligning the peaks and troughs of the odd and even slats.

FIG. 4 shows the blinds system of FIG. 1 with the upper, odd, header 13 moved ½ of a wavelength to the left relative to its position in FIG. 1. This lines up the peaks of the odd slats with the peaks of the even slats and creates gaps 40 in the blinds array that allows regions of visibility through the slat structure where the troughs of both odd and even align.

Figure 6:
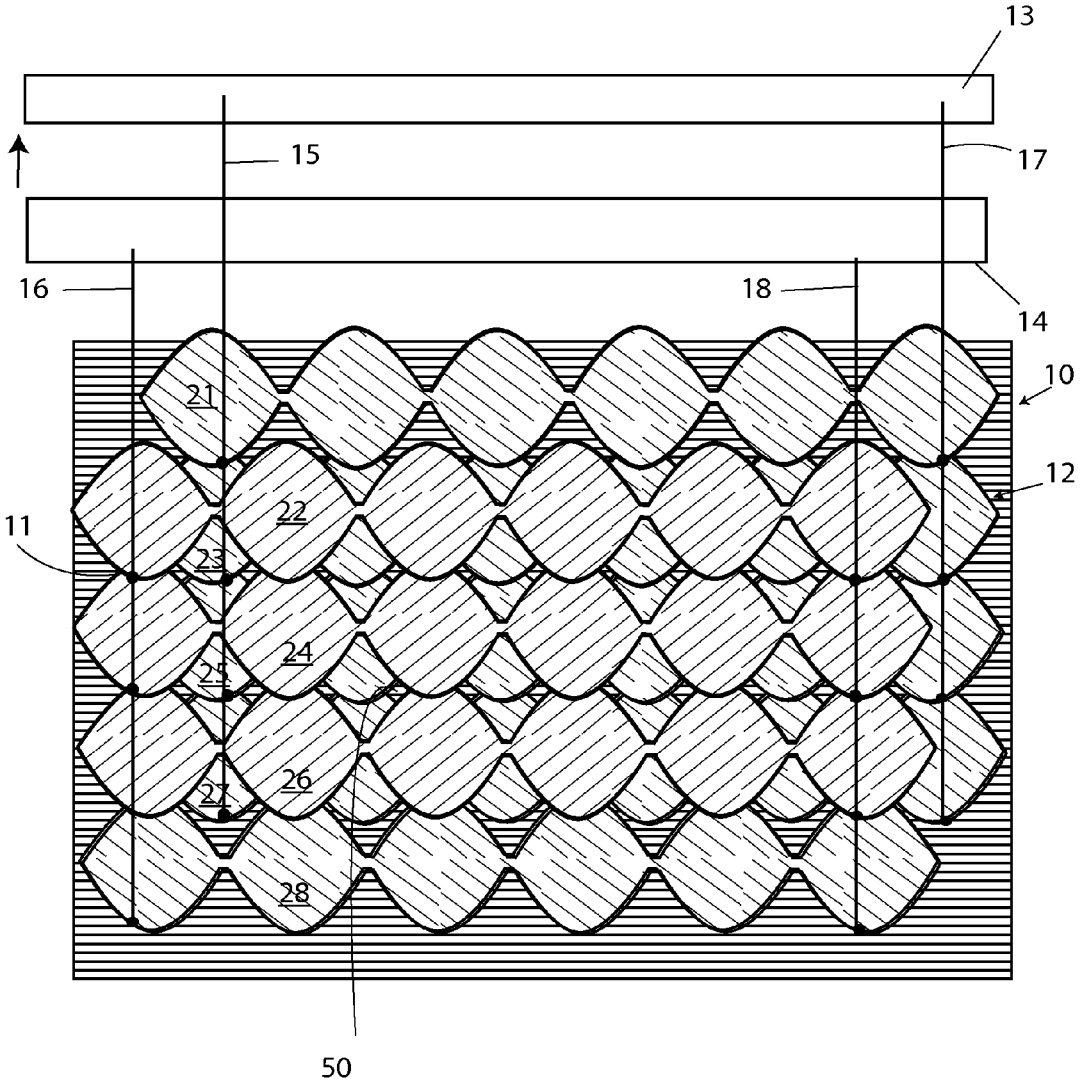
FIG. 6 shows the blinds system of FIG. 1 but with the odd head rail raised upward to an exaggerated extent.

FIG. 6 shows the blinds system of FIG. 1 with the upper, odd, header moved about ½ of a slat width higher relative to its position in FIG. 1. This reduces the overlap of the peaks covering the respective troughs and creates gaps 50 in the blinds array that allows regions of visibility through the slat structure, where the reduction in overlap allows. The cords are connected at specific points 11 to the slats. As shown in FIG. 6 this may not be a practical mode since the odd and even slats are moved so far vertically that they may get caught in each other as the slats are returned to the original position.

In more detail, FIGS. 7, 8, 9, 10, 11, and 12 show distinct overlapping configurations of slats each relative positioning, called a mode or state. Although many different arrangements are possible, for illustrative purposes six relative relationships are portrayed and discussed. The overlap mode of FIG. 1 is considered a completely closed starting-point mode. The notation used throughout will refer to this mode as neutral/neutral (N/N). The first neutral refers to the horizontal relationship and the second to the vertical relationship. The notation is horizontal offset/vertical offset.

1. Neutral/Neutral is the orientation seen in FIG. 1 and shown again in FIG. 7. The odd and even slats are horizontally arranged 180-degrees out of phase. Another way of saying this is that the peaks of the odd slates are aligned with the troughs of the even slats. Vertically, the so-called neutral point is with the peaks of the odd slats just covering the trough of the even slat below it. This notation treats horizontal offset as the odd slats in relation to the even slats. "L" is left, "U" is up, "N" was neutral and "D" is down.

Figure 7:
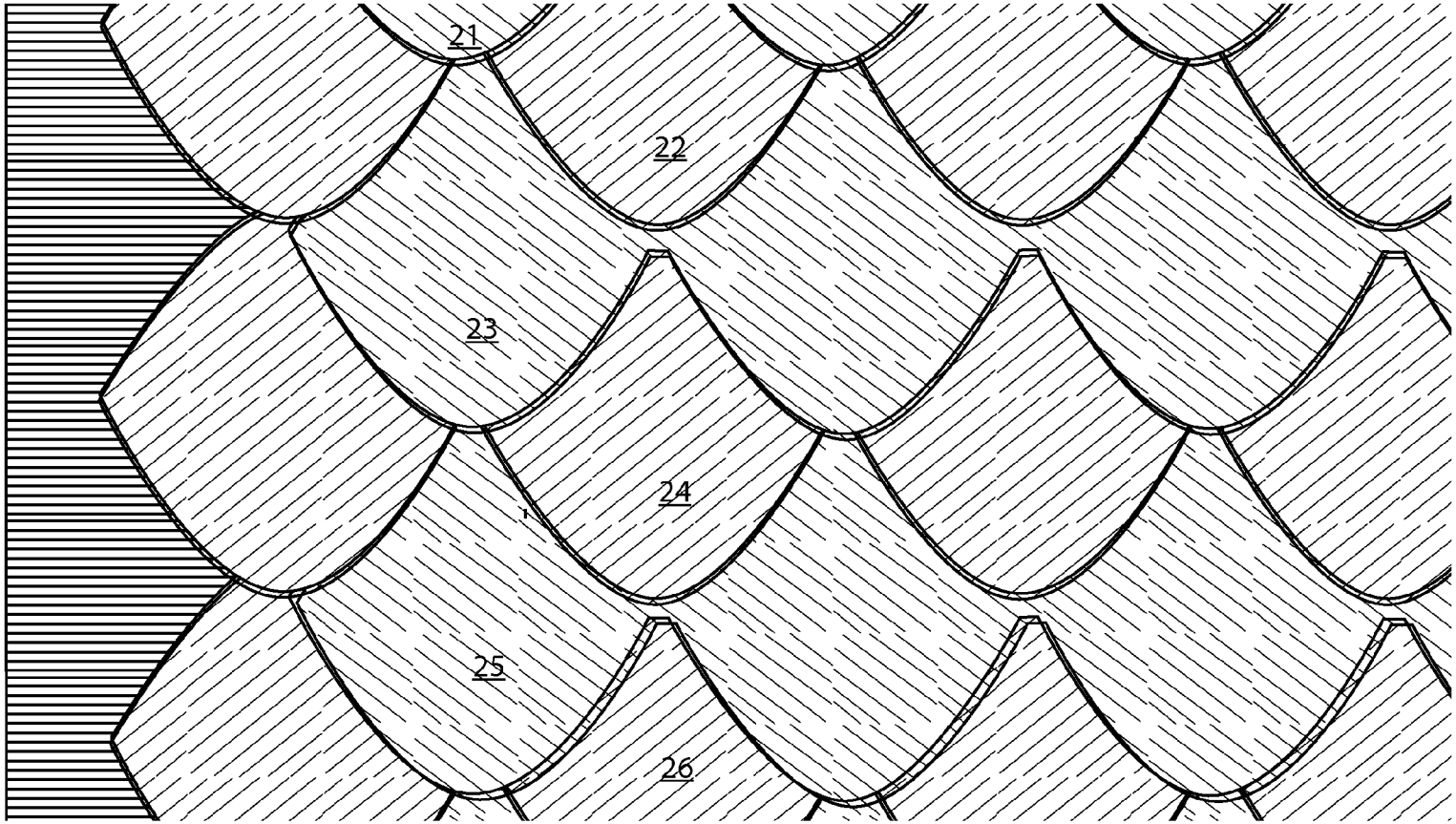
FIG. 7 shows a front, enlarged view of blind slats in an overlapped position as in FIG. 1 designated neutral/neutral.
Figure 8:
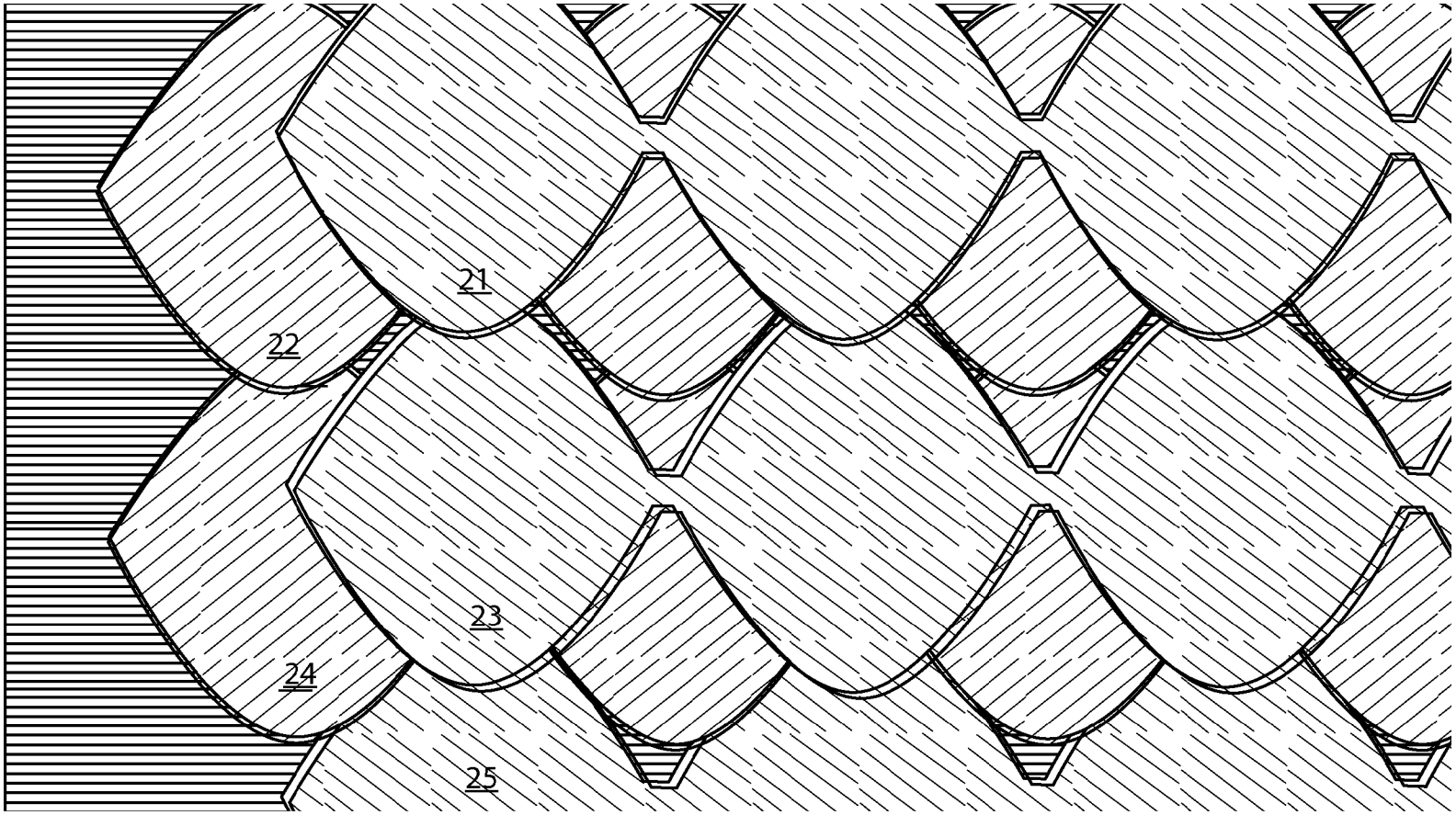
FIG. 8 shows a front, enlarged view of blind slats in an overlapped position designated neutral/down.

| | | | |
|---|---|---|---|
| N | N | FIG. 7 | Scalloped, scaled, or imbricated, all closed and blocked |
| N | D | FIG. 8 | Row of small diamond shaped openings. One row per pair of slats and one opening per peak (both even and |

-continued

Figure 9:
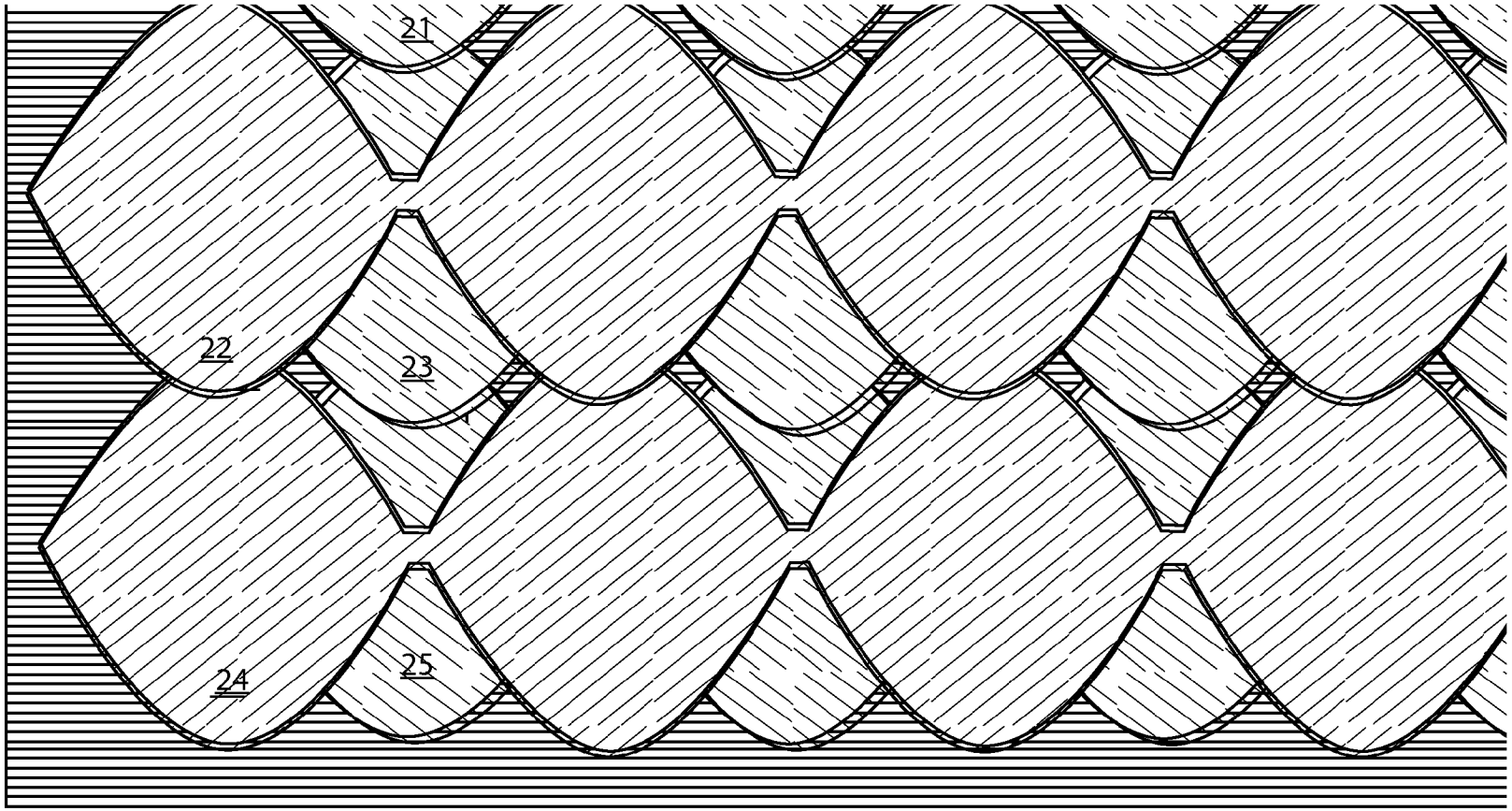
FIG. 9 shows a front, enlarged view of blind slats in an overlapped position designated neutral/up.
Figure 10:
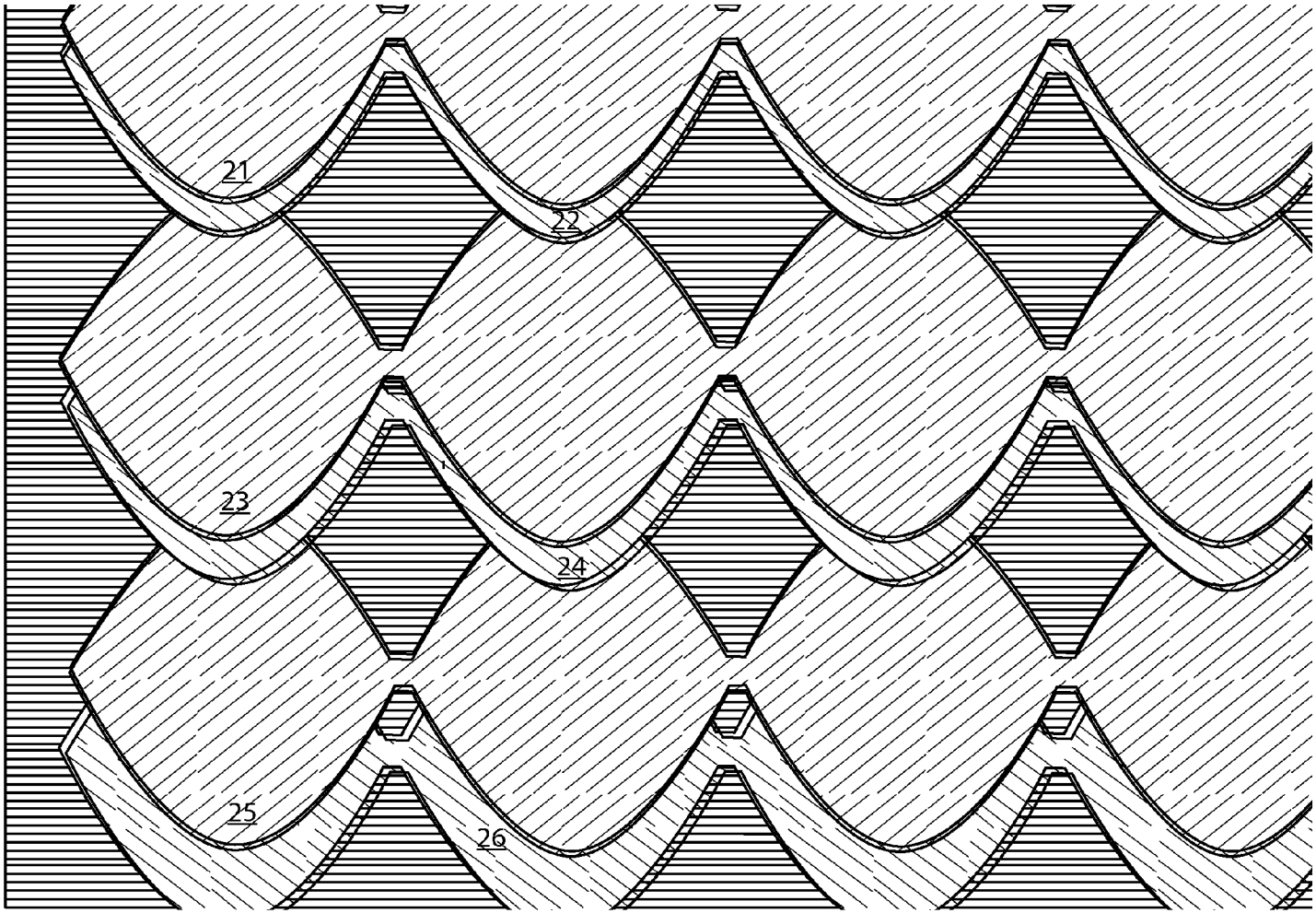
FIG. 10 shows a front, enlarged view of blind slats in an overlapped position designated left/down.
Figure 11:
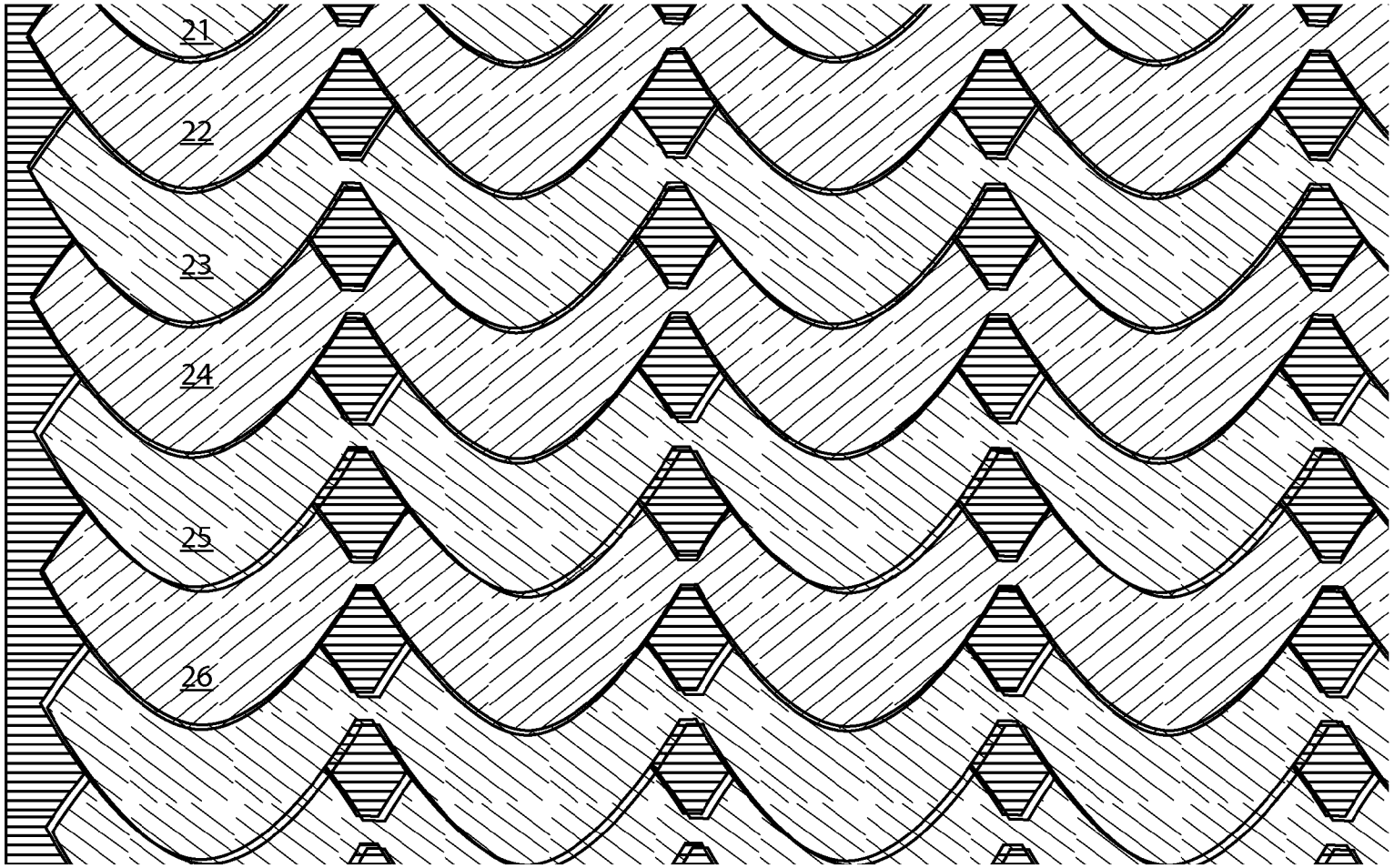
FIG. 11 shows a front, enlarged view of blind slats in an overlapped position designated left/neutral.
Figure 12:
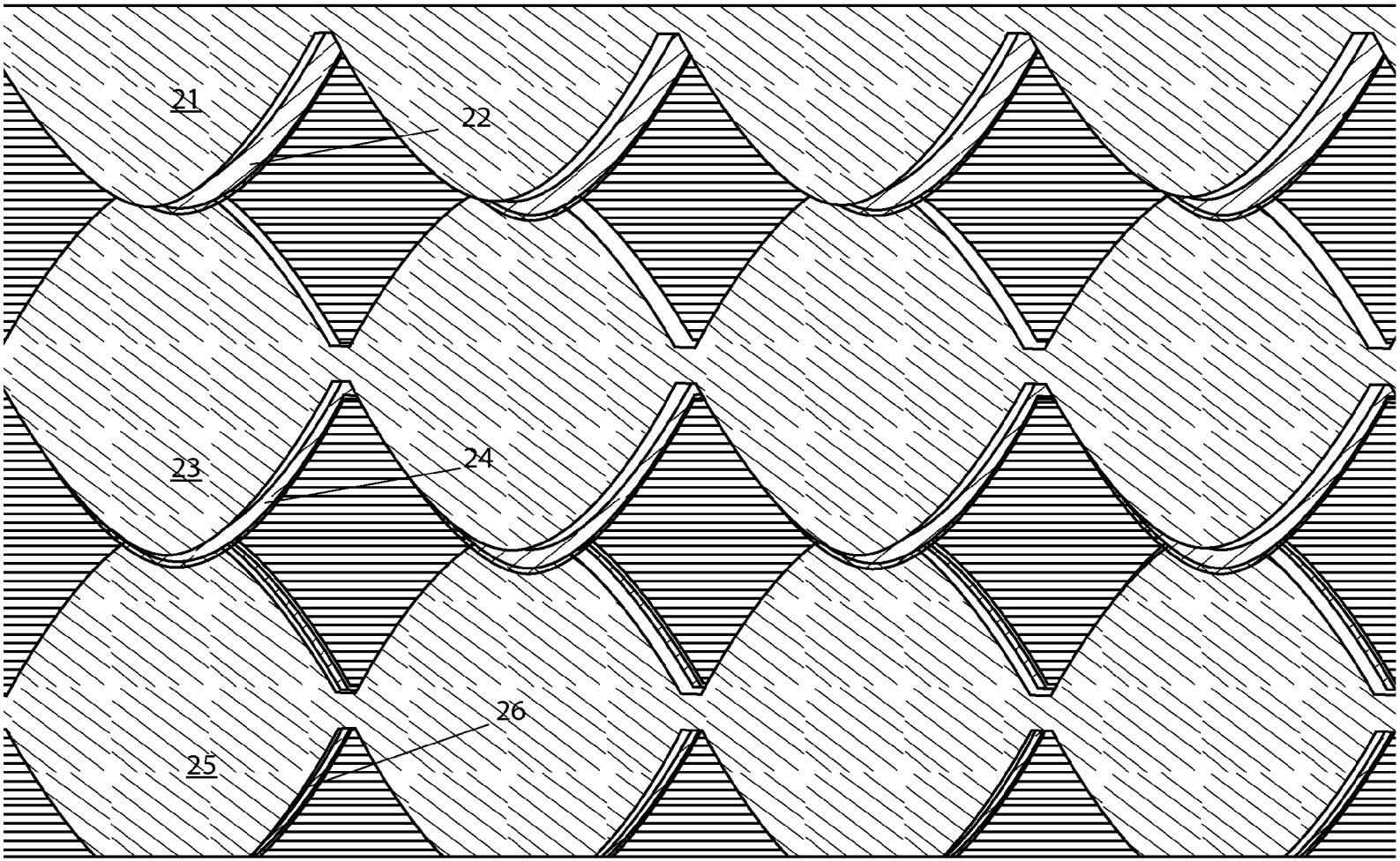
FIG. 12 shows a front, enlarged view of blind slats in an overlapped position designated left/down.

| | | | |
|---|---|---|---|
| | | | odd peaks). |
| N | U | FIG. 9 | Partial small V shapes (missing the point) made each side a slanted parallelogram |
| L | U | FIG. 10 | Large Diamond shapes |
| L | N | FIG. 11 | Medium sized hexagons. Two sizes, alternating |
| L | D | FIG. 12 | Large diamonds |

Colors

Figure 5:
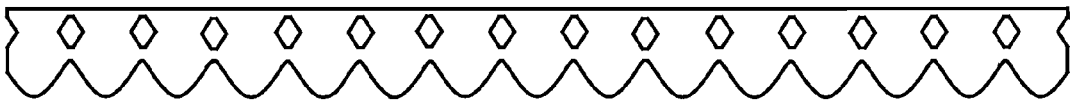
FIG. 5 shows an alternative slat shape with a solid top edge and diamond shaped cutouts.
Figure 13:
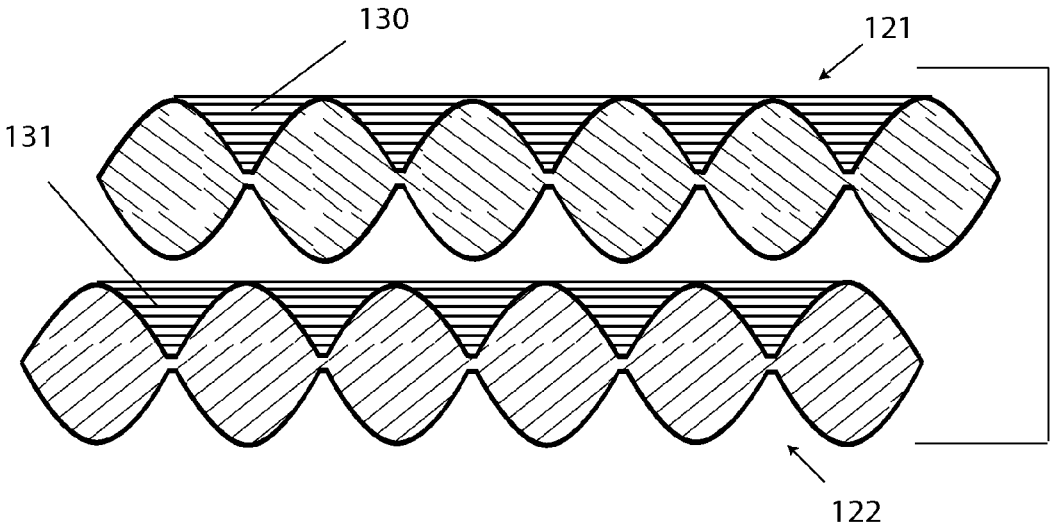
FIG. 13 shows a front view of two isolated slats, one odd and one even, each with colored gels in their upper portions.

In some embodiments, a strip of a colored translucent material can be part of one or more of the slats. FIG. 13 shows an odd slat 121 and an even slat 122 spaced apart vertically. The odd slat has a rectangular gel 130 attached to and behind the solid portion. It fills in the spaces between the upper "humps". The even slat has a gel 131 of a different color similarly attached. If a system of blinds like the one in FIGS. 1, 4, and 5 had colored gels various patterns of colors would present as the odd and even slats were moved horizontally and vertically in relation to each other. In particular, one version has strips, starting at the top, with the sequence of colors: cyan, cyan, yellow, yellow, cyan, cyan, yellow, yellow. One feature of this specific configuration is that in some positions an opening between solid slat portions shows an overlapped cyan/yellow producing green in combination. Some of the esthetics produced can be like an argyle pattern. In other versions of slats, there might be mirrored surfaces, crystal, lenticular, or prismatic features exposed and hidden by the relative motion of the slats.

Mechanisms

The versions above describe embodiments with two head rails, one supporting the odd slats and one supporting the even slats. One whole head rail is moved in relation to the other head rail to produce the modes and patterns. Several more advanced mechanism embodiments described herein can provide for a single head rail that supports and controls both odd and even slats and allows the various relative positions to be achieved. In the various mechanisms described there are odd ladders and even ladders. The mode notation is in terms corresponding to the even slats staying still while the odd slats move left, up and down. However, as mentioned, they are relative offsets. Embodiments might actually move only the odd slats, only the even slats, or might move both the odd and even slats to achieve the same relative motion. Moving one set of slats while the other remained static might generally take less mechanism and might reduce cost and complexity. However, moving both odd and even slats relative to each other has the property that each set can be moved less distance. Particularly in the left-right direction, this can help esthetically and preserve symmetry in the overall look of a window and its covering. Some mechanisms might find simplicity in dividing the problem by doing the whole horizontal movement with the odd slats and all the vertical movement with the even slats, or vice versa.

Problem of Two Degrees of Motion

It is desirable to have more practical implementations than the one described above with two independent head rails. It is particularly desirable to have a single head rail and have the various states or modes controlled by one or two continuous motion by user of one mechanical control. Mechanical controls in this field include rigid rods that are turned and loops of cords that are pulled downward. If one control was used for horizontal movement and a second independent control was used for vertical movement the design problem is simplified. But this can be at the cost of ease-of-use. If separate controls were applied to the two head rails implementation, the six modes can be reached by alternating using the horizontal control and the vertical control. Some practical systems can use this approach particularly a motorized version. However it can be desirable to have a sequence of up/down and left/right relative movements that reach the six nominal states all being cycled to by the use of a single mechanical control. Similar to the well-known tilt controls, a user-friendly control might involve turning a rod or pulling a cord loop in one direction until a stop is hit and then reversing to reach all desired states.

Figure 14:
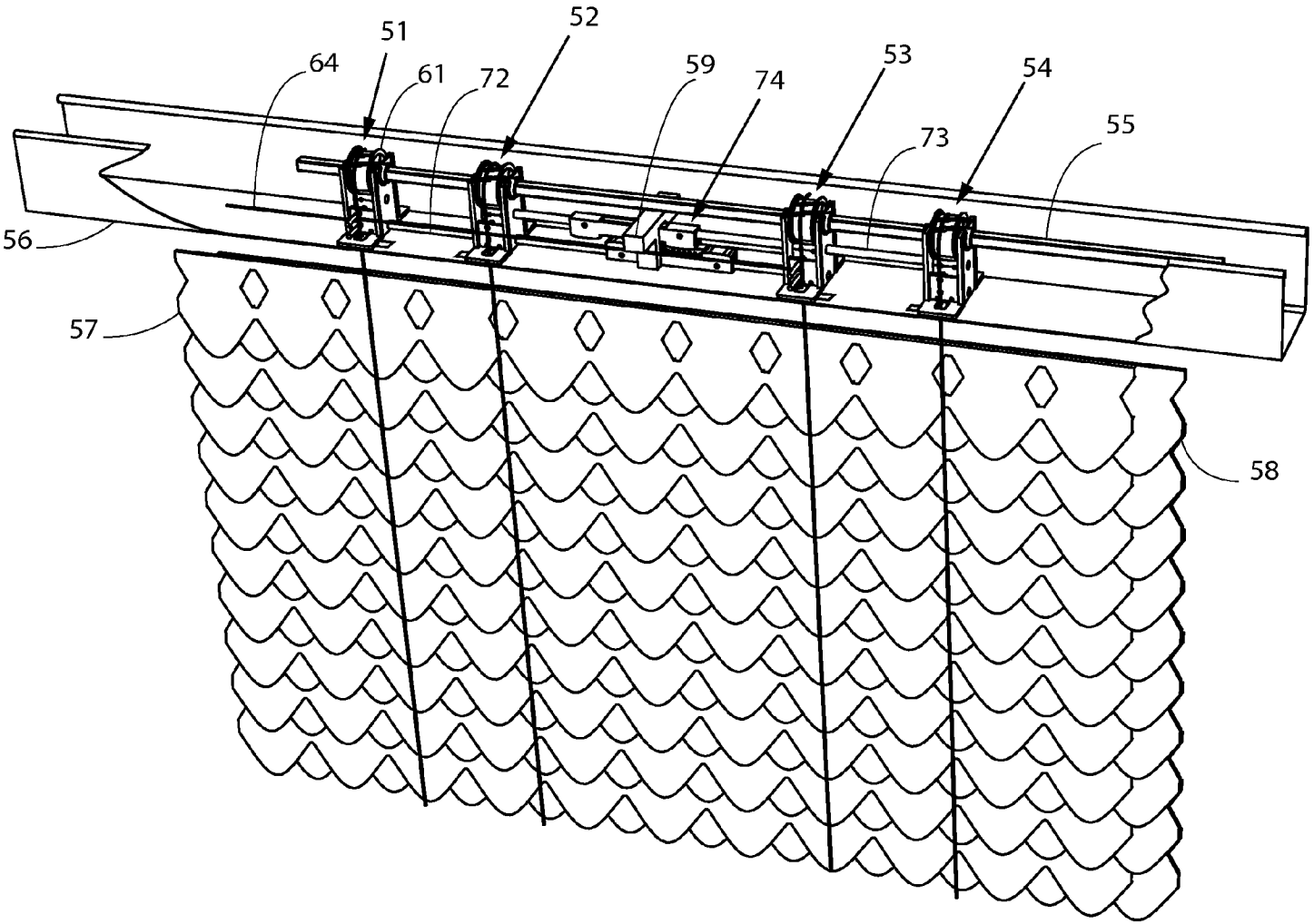
FIG. 14 shows a head rail and slats with cord support with variable positioning in both horizontal and vertical directions.

A general layout common to several embodiments is seen in FIG. 14. A blind of about 4 feet in width could support and control slats with two ladders, one on the left and one on the right. Each ladder would be supported by a ladder support assembly including a tilt barrel 61. In the class of embodiments described here, there would be four barrels. Since there are two sets of slats, on the left would be one to support the odd slats 51 and one to support the even slats 52 with a similar arrangement of odd slats 53 and even slats 54 on the right. All four barrels, in this case, would be driven from the same tilt rod 55. A top odd slat 57 and a topmost even slat 58 are followed by others.

The several embodiments in this class vary in the left/right movements of the various barrels and the way the ladder cords can be manipulated.

Embodiments Involving Changing Height by Diverting Ladder Cord

In order to achieve the relative vertical movement between even and odd slats this class of embodiments uses a hook that can divert the path of the odd ladder cords as seen simplified in FIG. 15A in a down state. The upper cord portion of the odd ladder 60 hangs straight down from the tilt barrels 61 with two pins 62, acting as stops, to one side. The tilt barrel is supported by a barrel cradle 65. The cord descends through the opening of a hook 63 on a horizontally disposed rod 64. When it is desired to lift the odd ladder, the horizontal rod can be moved to the left capturing the cord and pulling it against the two pins in a V-shape as seen in FIG. 15B. This effectively shortens the cord raising the odd slats that are resting on that ladder's rungs to the up position. The hook can be open or, more practically, can be a closed circle as shown.

The simplified view in FIG. 16 shows a system with only up/down control. There are two pairs of barrels; one on the left and one on the right (only left shown). Each pair includes an odd barrel and an even barrel, only the even barrels' cords are engageable by a hook. The barrels are in fixed positions as in a conventional blind system and provide no left/right relative movement of slats. However, by moving the cord diverter horizontal rods 64 64' leftward via the screw drive 70, the cords are effectively shortened and the odd slats are raised relative to the even slats. Since the weight of half of the slats is fighting this cord diversion it would be recommended to operate with a screw drive through a gearing that resisted back-drive or with a cord and ratchet system.

The slat system of FIGS. 17A, 17B and 17C show a slat configuration that provides a variable aesthetic and variable light allowance requiring no change in left/right positions, but with up/down motion alone. FIG. 17A shows a rectangular slat with two staggered rows of circular apertures. In FIG. 17B a pair of these slats, with one in a flipped orientation, are overlapped allowing no light. When the upper slat is raised the two slats take on the configuration of FIG. 17C. In that configuration openings are aligned allowing light transmission.

Left/Right Relative Motion Only

Taken independently of up and down motion, a horizontal translation can be achieved by sliding of the barrels that support the subset of slats to be translated. A version is shown in FIG. 18. Of course the opening 71 in the floor of the trough 66 would need to be wide enough to accommodate the ladder cords descending from the barrel in all left/right positions the barrel might take. In FIG. 18 only the odd cord support barrels 51 53 move. This motion can be achieved with a screw drive or a cord pull with bidirectional properties. The system could achieve a desired left/right translation by having even barrels fixed to the trough and odd barrels mutually coupled by a centrally located odd coupling rod 72 and moved in unison by a screw mechanism. The resulting aesthetics would be unsymmetrical.

Alternatively, both odd and even barrels could move in equal but opposite directions. Note that FIG. 14 shows a simplified drawing of a system with the linking rods 72 73 interconnected by a gearing 74 that reverses any left/right movement of the interconnected odd barrels 51 53 to cause complementary motion of interconnected even barrels 52 54. The reversing gears are supported by a bracket 59 seen in some figures. This would produce a symmetric esthetic.

Using Both Vertical and Horizontal Displacement

Including both the up/down only and the left/right only mechanisms in one system can be done in a straightforward manner with separate drives and control for each subsystem. However it would require a user to move back and forth between the two controls to put the slats though their various relative states. It may be desirable to have a single control operate both horizontal and vertical motion in a coordinated manner. This can result in simple user action that can move the state of the slats through its six nominal modes. One option seen schematically in FIG. 19 is a motorized system where the up/down and right/left structures would be mechanically distinct and each controlled by separate linear 80 81 motor or possibly a solenoid. The drive rods 82 83 of the respective motors would couple to the first odd cradle assembly 65 and the horizontal cord diverting rod 64. An electronic control could cause appropriate forwarding and reversing of the motors to cycle the system through any desired sequence of states in any desired order.

Whether by mechanical or electronic control methods, the two systems could have some inter-coupling in order to provide a smooth user experience to take the system through it states. One constraint in operating a horizontal and vertical systems such as this is that when the odd barrel is translated between its left and right, the cord diversion rod should be constrained to track that movement in order to maintain the same relative relationship between the cord and the hooks.

Combining Horizontal and Vertical Systems Mechanically Via Lost Motion

This describes a particular mechanical operating system for coordinated control of the left/right and up/down degrees of freedom of movement with a single screw-driven subsystem.

Structure

As in the previous embodiments, there are analogous pairs of barrels shown in FIG. 20 on the left and right portions of the system. Of course for a wider window, a third central pair or any practical number of pairs of barrels can be employed to provide the required support. To the left is the screw drive 70 and the operating system 90. The operating system mechanism is seen in an isolated and enlarged view in FIG. 21. The components of the operating system are, a base 91, a drive finger, a horizontal translation box, a left movement latch 95, and a right movement latch 96. These parts are seen in an exploded view of FIG. 23.

The operating system provides a sequence of motions to cause the slat support system of interconnected barrels and cord diversion hooks to move in a coordinated manner to cause odd and even slats to move to the six nominal relative positions. As mentioned previously and seen in FIG. 20, the components of the slat support system include a left even 52 and odd barrel 51 and a right even 54 and odd barrel 53. A centrally located upper linkage rod 73 connects the left even barrel to the right even barrel and analogously a second, lower, central linkage rod 72 connects the left odd barrel and the right odd barrel. Note that here are holes in the cradles that allow the odd linkage to pass through the even supports and the even linkages to pass through the odd supports. These rigid couplings force both odd barrels to move in unison and separately force both even barrels to move in unison. The two centrally located rods are configured one above the other and at a single point along their length are coupled by a rack pinion rack reversing gearing system 74. This constrains the odd and even systems to move in opposite and equal directions and is seen isolated and expanded in FIG. 22. There is a pinion gear 77 and two racks 76. Not shown in this view is the support bracket 69.

Further, in FIG. 20 there is seen a front cord diversion rod 64 running most of the length of the trough in front of the barrels and symmetrically a second identical rod 64' running behind the barrels (not visible in these views). As mentioned above, the cord diversion rod has hooks or circular openings 63 to capture the cord of only the odd barrels, seen better in FIG. 15A and FIG. 15B. These cord diversion rods just pass by even barrels ladder cords. In FIG. 21 we can see the coupling of the operating system to the slat support system is by the cord diversion rods 64 fixed to the drive finger and the leftmost odd barrel cradle 61 fixed to the horizontal movement box 93.

Operation

The box 93 slides left or right on the base and the drive finger's orientation in the box is configured so the finger can push the box along the base in both the left and a right direction but with a central dead zone. When the finger is in this zone is said to be operating in a lost motion manner since changes in its position do not translate to corresponding motion of the box. To positively secure the position of the box during the lost motion phase there are two latches that can selectively fix the box to the base. One latch 96 can hold the box in its leftmost position in the other latch 95 can selectively fix the box in its rightmost position. The relationship between structures on the drive finger, box, and in the latches is such as for the drive finger to release the appropriate latch as the finger reaches particular positions and when lost motion phase ends and the finger starts to engage the box positively.

Phases of Operation

From an initial state turning the drive screw in one direction causes the operating system to go from a closed/down (N/D) to a closed/½ down (N/N), to a closed/up (N/U) and an open/up (L/U) state. In parenthesis the notation used earlier is shown. When the screw is turned back the other way it goes from the open/up state to the open/½ up state to the open/½ down (L/N) to the open/down (L/D) and back to the start of the cycle at the closed/down state.

Several figures illustrate the states and activity of this subsystem. In FIG. 24A there is a perspective view of the subsystem in an initial closed/down state. FIG. 24B is a plan view and FIG. 24C is a side view. Shown sectionally is FIG. 24D, taken along D-D of FIG. 24B. This shows the base, finger, screw drive, horizontal translation box and the two latches. Note that the right latch 95 is secured around a post on the base preventing the box from moving as the screw moves the finger to the next state.

In the next state, closed/½ up, as seen in FIGS. 25A and 25B, the finger has moved away from the cradle 84 but the box is held positionally in place by the right latch. Further turning of the screw brings the subsystem to the open/up state as seen in FIG. 26. The right latch has been pulled back by the finger to become unlatched. Further turning now moves the box as the finger contacts that latch.

The screw drive is stopped when the next state (open/up) is reached as seen in FIG. 27. Note that in this state the left latch 961 locks to the base preventing the box motion as the finger moves back towards the right.

Next is the open/½ down state of FIG. 28 and after that the open/down of FIG. 29. At that point the left latch is unlocked allowing the box to be pushed right by the finger back into the final and initial state of closed/down.

Variation—End CAM

An alternative to the operating system described is an end cam combined with a side cam in place of the drive finger, box and latches. The coordinated movement relationship between the cord diversion rod and the left/right barrel movement can be "programmed" by a cam configuration.

Alternate Embodiment—Carriage and Shuttle

This embodiment will be described briefly. Unlike some other embodiments it does not raise odd slats in relation to even slats by cord diversion. One of the downsides of cord diversion can be that tilting may only be possible in the normal state. Due to the tension of the V diversion or the cords.

An alternative to cord diversion is decoupling of the terminus of the cord at the barrel from the location from which the cord descends downward. This can be done with an arrangement as seen in FIG. 30, and with some support structure removed, this view is also seen in FIG. 31. The base is a carriage 201 with an aperture 203 for a cord to descend from. The carriage supports a barrel guide 205. The barrel guide nudges the barrel 207 left and right along the tilt rod 200 and the barrel is moved. The barrel guide has a set of pulleys 210 to direct the ladder cords 211 down from the barrel and over to the descending opening.

Rather than the purely symmetric movement of the odd and even barrels found in earlier described embodiments, the odd carriages move symmetrically but the barrels do not.

To achieve the six states, the odd tilt barrel guides and tilt barrels first move to the left with their carriages fixed in position as seen in FIG. 31. This reduces the length of the cords and raises the odd slats. When the odd slats are in the "up" position, the carriages move equally and oppositely carrying the tilt guides left and right respectively and their barrels with them. As in other versions, this moves the odd and even slats. Analogously to some other versions, this can be implemented by a "lost motion" driven by feet 221 that rest in slots 223 defined by the carriages along with latches 225 to secure the carriage movement during the lost motion phase. Securing the carriage movement could be accomplished by sets of spring-loaded buttons on one of the carriages.

On the odd units, the barrel guide moves with the feet 221 while on the even units the feet 222 move independently and the barrel guide 208 is fixed to the carriage 202.

The feet are connected to a linking bar structure that fixes the odds together and separately fixes the evens together. Analogous to previous embodiments, reversing gearing make odd and even feet move in equal and opposite directions.

Subcomponents include front odd linkage 231, rear odd linkage 231' and front even linkage 232. Reversing gearing between the linkages includes rear linkage reversing gears 235' and front linkage reversing gears 235.

The scheme of front and rear linkages is applicable to the other embodiments presented as an alternative to the central rods.

Lift System

A standard feature of venetian blinds is the ability to lift all the slats upward. In systems of this teaching that employ only up/down positioning, the lift can be done in any conventional manner. On the other hand, in systems with L/R positioning the method of lifting by a slat through-hole approach has the difficulty that the holes in odd and even slats will be moving in opposite directions. A so-called privacy lift system runs lift cords along the front and the back side of slats without going through any slats. That type of lift would be compatible with L/R moving systems.

A fine point is that a system could benefit by having the cord lock for its lift cords mounted to a plate slideably configured in the head rail trough and coupled to the movement of the even barrels and barrel supports. The reason for this is that if the lift cords descend from a point that moves, the lock should move in unison or there may be a slack issue within the head rail. Lift cords might descend only from even cradles and thus there would be no slack issue in the lift cords.

Bottom Rail

In some embodiments and installations, it may be desirable to have an active bottom rail. While the embodiment described above moves the cord supports in a positive manner, the slats further down the blinds may need help with their left to right direction movements. Without a bottom rail at all and with little slat-to-slat friction or mutual interference all the odd slats will move together and all the even slats will move together.

Slat-to-slat interference can be an issue. Since it is hard to "push a rope" the odd and even slats will separate and come together with the head rail system's actions only if they are hanging freely without odd to even touching or cords interfering.

One way interference can be minimized is to have the slats at a slight tilt when the left-right directions movement is being engendered. A coupling between the tilt bar and the operating system or linkage bars or rods could cause a small, temporary tilt when the carriage is moving between its N position to its L position and visa versa. In a second approach, an action could perturb the slats allowing them to separate and end up hanging straight.

Active Bottom Rail

Alternatively, a unified bottom rail can have distinct attachment points respectively for the odd and even ladder termini. The attachment points can be actively driven apart and together in unison with the ladder openings in the head rail. Unless the blinds are quite long or have significant slat-to-slat interference, pulling them apart and together at both the top and at the bottom can be adequate to move the slats as desired. Tension on the cords can make it less like pushing a rope and improve the performance at the mid-way up point in the blinds.

Embodiment 1 of an Active Bottom Rail

In this active bottom rail version there are two sliding structures driven from the state of the head rail. They move in concert with the head rail cord supports in order to have the bottom of the odd and even ladders maintain the same relative horizontal spacing as the tops of those ladders and also for the lift cords to remain perpendicular to the floor.

In one version of this approach the left ladder control subsystem has a spring-loaded take-up reel and a dedicated pulley for each of two control cords. The control cords extend from the head rail to the bottom rail. Their purpose is to convey the information as to the L-R slat movement at the top to the bottom. This is accomplished by the control cords being pulled upward when the odd and even carriages move apart. Corresponding odd bottom rail carriages are pushed leftward by the upward pull on the control cords. The reversing linkage causes the even carriages of the bottom rail to move in a mirror image manner.

In more detail and with reference to figures: the bottoms of the odd ladders are attached to bottom odd carriages and the bottoms of the even ladders are attached to bottom even carriages. The bottom carriages are attached to bottom slide assemblies. The slide assemblies are seen in FIG. 34. The odd slide assembly 601 and the even slide assembly 602 each have a slider guide 630 in which their respective slides 603 604 glide. The two guides are attached to a bottom rail housing, not seen in FIG. 34 by standoff plates 602. This arrangement allows the two slides to move freely in a horizontal direction. However, they do not move independently. A reversing linkage system 613 614 615 couples them such that they are constrained to move in opposite directions. A given rightward motion of one causes an equal but leftward motion of the other due to the odd and even linkages 613 614 being connected to opposite ends of a pivoting reversing linkage 615. The reversing linkage pivots about its center at a pivot point 700.

FIGS. 35A and 35B show, schematically, how head rail cord support drives corresponding movement of the bottom rail carriages. In these simplified diagrams the right cord supports are not shown. FIG. 35A shows the upper left odd and even cord supports with a control cord 620FWD extending down from them to the lower left odd carriage 609. The control cord is not secured to the lower odd carriage. Rather it is seen in these figures as being strung against the right edge of the odd carriage, being brought leftward under the odd carriage and being secured to the odd post 618. The odd carriage is seen attached to the odd slide 603 in FIG. 35B. As mentioned, the odd slide is free to move in a left-right direction. An upward pull on the control cord 620FWD in FIG. 35A would impart a force to the odd carriage. Due to the motion constraints on the odd slide that force will tend to cause a leftward motion of the odd carriage and odd slide. One inch of upward motion of the cord will causes about 1 inch of leftward motion of the carriage, depending upon the geometry of the cord's path.

In this case, the goal is to translate 1 inch of leftward motion of the upper carriage into 1 inch of leftward motion of the bottom carriage. As seen in FIG. 35A, the control cord 620FWD originates at a point secured to the left upper even carriage 701 and then goes around a pulley 650 secured to the odd upper carriage. When the odd and even carriages move 2 inches apart by each moving 1-inch absolutely, the control cord is pulled upward 2 inches since it is stretched between to two upper carriages 4000D 400EV. At first thought, this might be imagined to cause a 2-inch movement to the left of the lower odd carriage. However, the point of descending of the cord has moved an inch to the left subtracting one of those inches. The net effect is the odd bottom carriage moves an inch to the left. This is the same distance the upper odd carriage moves to the left, thus producing the desired outcome of having both upper and lower carriages moving in unison. For this action to work in reverse as the upper carriages return to their original positions, the even slide is connected to the post 619 by a return spring 623.

As schematically diagramed in FIG. 35B, the odd and even lower carriages are secured to the odd and even slides. Due to the reversing linkage 613 614 615 the leftward movement of the odd carriage causes a mirror image rightward movement of the even carriage. FIGS. 36A, 36B, and 36C, show three dimensional representations of the lower left odd carriage, the two control cords 620FWD 620BK, the odd and even slide termini, and the posts 618 619 and spring 628.

FIGS. 37A and 37B show the bottom rail left ladder control mechanism in greater detail. The ladders are omitted for clarity in understanding the control cords and the lift cords. The front and back control cords 620FWD 620BK are seen going through apertures 611 in the odd carriage 609 and are then led leftward to their respective posts 617 618. The left two lift cords are attached at points on the even carriage 612. The odd ladder termini would attach at points on the odd carriage 610 and corresponding points 610 on the even carriage. While the ladders are omitted from FIG. 37A, all the cords are omitted from 37B for clarity of illustrating portions of the bottom rail mechanism.

For the relative movement of the top odd and even cord supports to actually pull on the control cords to cause action in the bottom rail the cords would need to have no slack in them at the point they were intended to be used. As mentioned, in this embodiment the mode changing is designed to operate when the blinds are fully lowered. By adjusting the length of the control cord, it is set to reach the end of the reel when the blinds are fully lowered. At other points the control cord is not functional but the slack is taken up.

Embodiment 2 of an Active Bottom Rail

In this version shown in FIG. 38 and FIG. 39 the slide assemblies, carriages and reversing linkage are the same as in the first embodiment. However, there are no control cords. Rather than changes of mode at the top signaling state changes at the bottom, the same wand motion directly controls both the top and bottom states. In this version, the odd slide is elongated on the left. At the left side of the bottom rail housing is a notch (not shown) that accommodates a particular design of a mode wand. In this case, the lower portion at least of the mode wand, has a gear-like profile. Set in the notch it engages a pinion gear 521 in the bottom rail that drive a rack 520 to move the odd slide and thus, as in the previous version, the odd carriage, the even slide and the even carriage.

When a mode change is desired, the user sets the mode wand into the notch and turns it. The same twisting motion actively drives both the top and bottom.

Alternative Implementations of Bottom Rail

There are both variations on the first embodiment as well as quite different embodiments.

Variations on Embodiment #1

One type of variation would be to motorize the mechanism with an electrical remote control motor in the head rail operating the mode drive in order to remove the wand. In some variation, the bottom rail could have a separate motor and the way the bottom and top have coincident movement can be by a pair of "control cords" that carry an electrical signal from the head rail to the bottom rail.

Tape Lift Rather than Cord

Another variation is to use a tape ladder rather than a cord ladder. In that case, the lift cords and control cords could be hidden within an outside layer of cloth tape and an inner layer. This is shown in FIG. 40 a plan view. Shown in an exaggerated, schematic fashion, the lift cords 813 are sandwiched between an inner tape ladder rail 811 and an outer faux tape ladder rail 812. The rails support the tape rungs 810. Another approach would to have only a one-layer tape rail with the lift cords or strung in and out of the tape like a shoelace (not shown).

Pairs of Sliding Rollers Ladder Control Version

Figure 41:
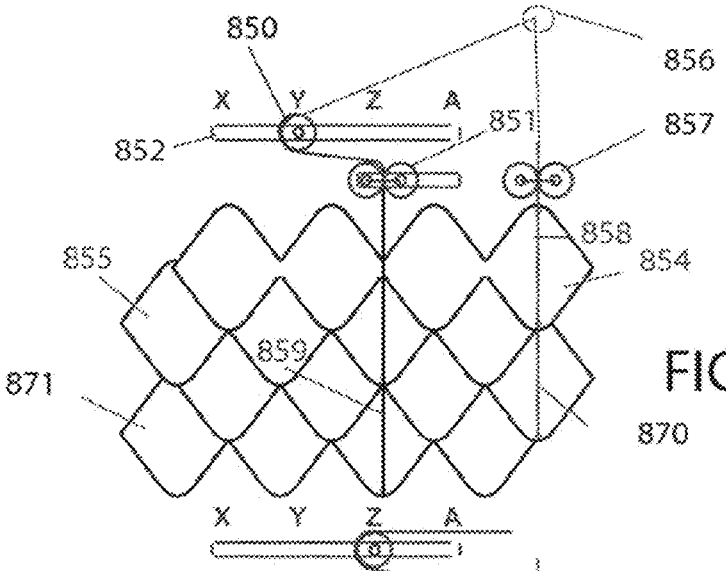

In this embodiment as seen in FIG. 41, separate cord ladders connected to a common head rails system. There are six different positions the apparatus can put the slats in. Four that have different esthetic effects are shown. FIG. 41 shows a simplified version of a system with all of the movement being done by the even slats and the odd slats remaining fixed. Only slats 854, 855, 870, and 871 are shown. The problem is to both be able to raise the slat, lower the slat, and move it to the left by the manipulation of one or more operational cords.

Slats 855 and 871 are connected to an "even" ladder cord 859 whose ladder cords go through two distinct rollers, in turn. Coming up from the ladder, the ladder cord first goes partially around a left-right slideable to lower roller pair 851. That roller pair constrains the cord to depend from the head rail between its two rollers. It has two operative positions A and Z in horizontal slat 851. This lower slidable roller is used to move the even slats between a left position and a right position. After going through that lower slidable roller, the cord continues upward to wrap partially around a second roller 850 that is wholly to the left of the lower roller. The function of the upper roller is to take up or let out cord slack causing the even slats 855 and 871 to raise up and down. The upper end of the cord is held fixed at point 856 during this slack taking and giving. This nominally fixed upper end of the cord can be attached to a tilt mechanism.

The two slideable rollers can be moved left and right. One way to accomplish that is by each being spring connected (not shown) to the far right side of the head rail system such that they are held against their rightmost positions by the springs. Cords (not shown) attached to the sliding rollers could be drawn to the left and down to be controlled by a user. These cords could be selectively manipulated to put the even slats in each of the six positions.

Figure 42:
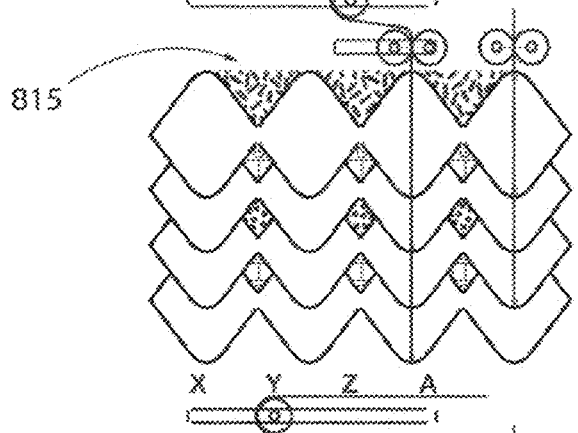

In operation, the lower roller might first be moved from Y to position A in order to engender a purely leftward motion of the even slat. However, this also has the side effect of adding slack and therefore tending to lower the even slats also. If that is not intended, then the upper roller can be moved from position Z to position Y to take up exactly the amount of slack released by the leftward movement of the lower roller. Further movement of the upper roller to position "X" would raise the even slats while preserving its leftward position. In this way, by manipulating one, the other or both rollers, the desired relative positions between even and odd slats can be obtained. Four of the stated are illustrated in FIGS. 41, 42, 43, and 44 With colored gels in the slats in a sequence of yellow, yellow, cyan, and cyan. FIG. 41 shows no color, all are overlapped and blocked. The upper roller is at position Y and the lower at position Z. FIG. 42 shows the even slats moved to the right. The lower roller has been moved to the right to position A. This moves the even slats rightward but also tends to raise the even slats. To prevent that, the upper roller is moved to position Z, releasing the needed amount of slack. The pattern observed in the exposed gaps is yellow, green, cyan, green, yellow, green, cyan, and green.

Figure 43:
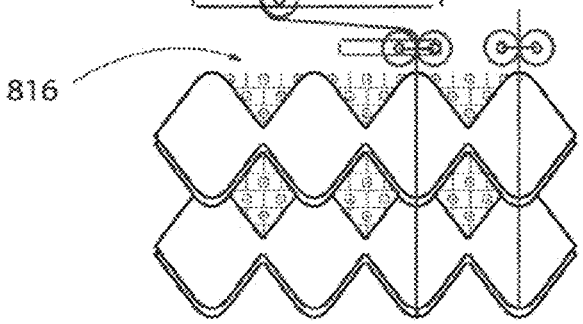
Figure 44:
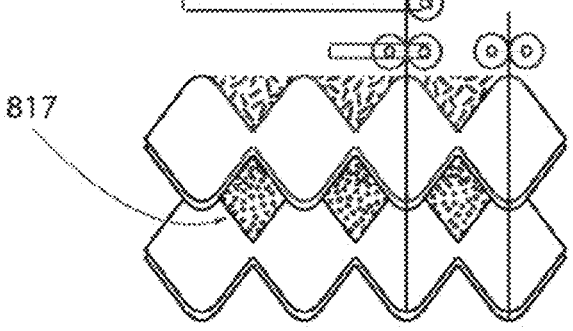

In FIG. 43 the even slats are right and up. This is accomplished by the upper roller being in position Y. The pattern shown is all green 817. In FIG. 44 the mode is right and down. The upper roller is in position A, allowing more slack and lowering the even slats. The pattern here is yellow 815 cyan 816. Note the color legend.

The static ladder 858 supports the odd slat 854. It also is terminated at position 856.

Alternate Lift System

Rather than have lift cords of the "privacy" type where the cords are guided from top to bottom by cord loops on the ladder rails another approach uses holes and slats. In FIG. 45 a set of slats is shown in a neutral position, and in a simplified manner. The odd slats 890 have holes 892 for a lift cord on their left ends and for even slats 893 on their right ends. When the odd and even slats are aligned as in FIG. 45 the list cords pass through the holes and slots.

As seen in FIG. 46, if the odd slats are moved to the left and the even slides to the right, the cords on the left follow the holes in the odd slats and move in relation to the slots of the even slats. On the right side it is the opposite. The cords follow the holes in the even slats and move within the slots of the odd slats. In this manner, one lift cord is provided for the left side of the blinds and another for the right. Due to the alternating slot and hole structure, the left and right horizontal movement of the slats is permitted.

Alternative Slat

As mentioned above, the relative motion of slats might not expose uncovered window areas but only portions of the slat below. FIG. 47 shows a slat 897 with a straight upper edge and a scalloped lower edge. It has a repeating star 900 pattern. In FIG. 48 a blinds system with that slat is shown in an overlapping mode with a special header slat 898 having no stars. No stars are exposed. When the odd slats are moved leftward and upward the effect of FIG. 49 is seen, with stars exposed.

Those skilled in the art will be aware of materials, techniques and equipment suitable to produce the example embodiments presented as well as variations on those examples. This teaching is presented for purposes of illustration and description but is not intended to be exhaustive or limiting to the forms disclosed. Many modifications and variations will be apparent to those of ordinary skill in the art. The embodiments and versions help to explain the principles of the invention, the practical application, and to enable others of ordinary skill in the art to understand it. Various embodiments with various modifications as are suited to the particular application contemplated are expected.

In the following claims, the words "a" and "an" should be taken to mean "at least one" in all cases, even if the wording "at least one" appears in one or more claims explicitly. The scope of the invention is set out in the claims below.

What is claimed:

1. A mechanism for operating a blinds system comprising a head rail with operational tilt supports for at least four ladders, where at least two ladders each comprise a front rail, a rear rail, and transverse rungs, and where at least two of the ladder tilt supports are configured to support a first pair of the ladders, and at least two other ladder tilt supports are configured to support a second pair of the ladders, the mechanism such that the first pair is configured to be adjustable by user control relative to the second pair along at least one axis, such that first slats supported by the first pair of ladders would move relative to second slats supported by the second pair of ladders, where said relative movement is a translation in space along at least a horizontal or a vertical axis relative to the head rail, and where a tilting in-place motion does not itself constitute translation, and where vertical translation, if any, is accomplished by equal effective shortening and lengthening of the front and rear rails of the second pair of ladders where the upper termini of the left and right rails are fixed to a tilt barrel and have no freedom of vertical movement and the effective shortening and lengthening is accomplished by horizontal movement within the head rail of at least a portion of the front and the rear rails proximate to the tilt barrel.

2. The mechanism of claim 1 where the relative movement comprises horizontal movement where horizontal movement is movement in a line parallel to the major axis of the head rail.

3. The mechanism of claim 1 where the relative movement comprises vertical movement where vertical movement is movement in a line perpendicular to the major axis of the head rail.

4. The mechanism of claim 3 where the portions of front and rear rails proximate to the tilt barrel are pulled into a horizontal V configuration to raise the associated slats.

5. The mechanism of claim 1 in combination with at least two pairs of corresponding ladders.

6. The mechanism of claim 1 where the first pair of ladder supports move slidingly in the head rail, in the direction of the length of the head rail, relative to the second pair of ladder supports.

7. The mechanism of claim 1 where the relative movement comprises both horizontal and vertical movement with respect to the head rail.

8. The mechanism of claim 1 where the relative movement comprises the first pair of supports moving relative to the head rail and the second pair of supports remaining stationary with respect to the headrail.

9. A blinds support system comprising at least two distinct sets of ladder supports mounted in a single head rail, the respective support sets configured to control the positions of two distinct, respective sets of slats, the slats operationally coupled to the supports via ladders, such that a first set of slats of the two respective sets of slats suspended from a first set of supports of the at least two distinct sets of ladder supports may be positionally translated, under user control, relative to a second set of slats of the two respective sets of slats suspended from a second set of supports via ladders having a front rail, rear rail, and transverse rungs; the second set of supports comprising at least two, of the at least two distinct sets of ladder supports, and where positional translation is movement along at least a horizontal axis or a vertical axis and where a tilting motion, itself, does not constitute a translation and where vertical translation, if any, is accomplished by equal effective shortening and lengthening of the left and right rails of the ladders that support the second set of slats where the upper termini of the left and right rails are fixed to a tilt barrel and have no freedom of vertical movement and where the effective shortening and lengthening is accomplished by horizontal movement within the head rail of at least a portion of the front and the rear rails proximate to the tilt barrel.

10. The blinds support system of claim 9 where the translation comprises vertical movement of at least one of the sets of slats.

11. The blinds support system of claim 9 where the translation comprises movement of at least one of the sets of supports along a line parallel to the major axis of the head rail.

12. The blinds system of claim 9 having at least three states relative to a base state: at least a first state reflecting a vertical translation of at least one of the sets of slats from the base state, at least a second state reflecting a horizontal translation of at least one of the sets of slats from the base state, and at least a third state reflecting both a vertical and a horizontal translation of at least one of the sets of slats from the base state.

13. The blinds system of claim 9 where the relative translation comprises both pairs being in motion relative to the head rail.

* * * * *